US010600631B2

(12) United States Patent
Giles et al.

(10) Patent No.: US 10,600,631 B2
(45) Date of Patent: Mar. 24, 2020

(54) ION TRAP

(71) Applicant: SHIMADZU CORPORATION, Kyoto (JP)

(72) Inventors: Roger Giles, Manchester (GB); Matthew Clive Gill, Manchester (GB)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 16/118,736

(22) Filed: Aug. 31, 2018

(65) Prior Publication Data

US 2019/0103263 A1 Apr. 4, 2019

(30) Foreign Application Priority Data

Sep. 29, 2017 (GB) ..... 1715777.7

(51) Int. Cl.
*H01J 49/42* (2006.01)
*H01J 49/40* (2006.01)
(Continued)

(52) U.S. Cl.
CPC ..... *H01J 49/4225* (2013.01); *H01J 49/067* (2013.01); *H01J 49/24* (2013.01); *H01J 49/403* (2013.01); *H01J 49/4295* (2013.01)

(58) Field of Classification Search
CPC ..... H01J 49/067; H01J 49/06; H01J 49/24; H01J 49/40; H01J 49/403; H01J 49/4225; H01J 49/4295
See application file for complete search history.

(56) References Cited

U.S. PATENT DOCUMENTS 5,652,427 A * 7/1997 Whitehouse ..... H01J 49/0481 250/282
6,545,268 B1 4/2003 Verentchikov et al.
(Continued)

FOREIGN PATENT DOCUMENTS

JP 9509781 A 9/1997
JP 2010512632 A 4/2010
(Continued)

OTHER PUBLICATIONS

Communication dated Mar. 26, 2018 from the U.K. Intellectual Property Office in priority GB Application No. 1715777.7.
(Continued)

*Primary Examiner* — David E Smith
(74) *Attorney, Agent, or Firm* — Sughrue Mion, PLLC

(57) ABSTRACT

An ion trap having a segmented electrode structure having a plurality of segments consecutively positioned along an axis, wherein each segment of the segmented electrode structure includes a plurality of electrodes arranged around the axis. A first voltage supply is configured to operate in a radially confining mode in which at least some electrodes belonging to each segment are supplied with at least one AC voltage waveform so as to provide a confining electric field for radially confining ions within the segment. A second voltage supply is configured to operate in a trapping mode in which at least some of the electrodes belonging to the segments are supplied with different DC voltages so as to provide a trapping electric field that has an axially varying profile for urging ions towards and trapping ions in a target segment of the plurality of segments. A first chamber is configured to receive ions from an ion source, wherein a first subset of the segments are located within the first chamber. A second chamber is configured to receive ions from the first chamber, wherein a second subset of the segments are located within the second chamber, and wherein the target
(Continued)

segment is one of the second subset of segments. A gas pump is configured to pump gas out from the second chamber so as to provide the second chamber with a lower gas pressure than the first chamber. A gas flow restricting section is located between the first chamber and second chamber, wherein the gas flow restricting section is configured to allow ions to pass from the first chamber to the second chamber whilst restricting gas flow from the first chamber to the second chamber.

18 Claims, 12 Drawing Sheets

(51) Int. Cl.
*H01J 49/06* (2006.01)
*H01J 49/24* (2006.01)

(56) References Cited

U.S. PATENT DOCUMENTS 9,129,787 B2 * 9/2015 Bateman ..... H01J 49/027
2002/0121594 A1 * 9/2002 Wang ..... H01J 49/004 250/281
2008/0142705 A1 * 6/2008 Schwartz ..... H01J 49/0045 250/292
2010/0072362 A1 3/2010 Giles et al.
2011/0284738 A1 * 11/2011 Berg ..... H01J 49/0072 250/283
2011/0303838 A1 * 12/2011 Green ..... H01J 49/4265 250/282
2014/0061457 A1 * 3/2014 Berdnikov ..... H01J 49/0095 250/281
2017/0221694 A1 8/2017 Papanastasiou et al.

FOREIGN PATENT DOCUMENTS

JP 2010514103 A 4/2010
WO 9523018 A1 8/1995
WO 99/62101 A1 12/1999
WO 01/78106 A2 10/2001
WO 2008/071923 A2 6/2008
WO 2008118231 A2 10/2008

OTHER PUBLICATIONS

Extended European Search Report dated Feb. 12, 2019 issued by the European Patent Office in counterpart application No. 18191514.1.

* cited by examiner

320

322

370
373
372
379
375
376
378
374

312
307
304
370
327
305
306
-324-
326
302
-303-
301
308
350
340
360

ION TRAP

FIELD OF THE INVENTION

This invention relates to an ion trap, preferably a linear ion trap for use with a time-of-flight mass analyser

BACKGROUND

A linear ion trap time-of-flight ("LIT-TOF") mass spectrometer is a known device for analysing ions.

Typically, in an LIT-TOF instrument ions are trapped in a Linear Ion Trap ("LIT"), cooled and then extracted by application of an extraction voltage. The extraction voltage accelerates ions towards a time-of-flight ("TOF") analyser. A TOF analyser is capable of undertaking mass analysis of the ions initially trapped in the LIT.

The present inventors have observed that if the pressure of a buffer gas in the LIT of a LIT-TOF instrument is too high, the performance of the instrument may be compromised due to the scattering of ions from buffer gas atoms/molecules during their extraction from the LIT. Furthermore, if the pressure in the LIT is high then the pressure in the TOF analyser maybe compromised, and/or additional pumping of the TOF analyser may be necessary. High pressure in the LIT may also result in fragmentation of ions, degradation of the TOF resolving power, transmission and the peak shape. High pressure may also lead to electrical breakdown when an extraction voltage is applied to extract ions from the LIT, thus limiting the magnitude of the extraction voltage that may be applied. This in turn will lower the maximum resolving power achievable.

If on the other hand the pressure is reduced in the LIT, the time for ions to reach thermal equilibrium with the background gas becomes longer, and consequently the time between the extraction of subsequent ion bunches from the LIT must be extended accordingly. In other words, the scan rate becomes low and this will result in degradation of the performance of the mass spectrometer, specifically the dynamic range, mass accuracy, sensitivity and the capability to follow dynamic events, e.g. when the molecular composition of the analyte changes rapidly in time.

U.S. 2010/072362A1 describes a segmented linear ion trap for receiving sample ions supplied by an ion source. A trapping voltage is applied to the segmented device to trap ions initially into a group of two or more adjacent segments and subsequently to trap them in a region of the segmented device shorter than the group of segments. The trapping voltage may also be effective to provide a uniform trapping field along the length of the device. The ion trap comprises a plurality of electrodes. The method of ion trapping taught by U.S. 2010/072362A1 uses a segmented linear quadrupole ion trap.

FIG. 1 is a simplified drawing of a linear ion trap 101 implementing the principles of U.S. 2010/072362A1, and a DC voltage profile 100 applied to the electrodes of the linear ion trap 101.

In this example, the linear ion trap 101 shown in FIG. 1 has seven segments, all having the same radial dimensions. A common RF voltage and individual DC supply is connected to each segment. The DC voltage profile 100 is applied to the segments for trapping ions in the central segment. The ion trap is filled with a buffer gas of uniform pressure. A collection of ions, having a range of m/z values are introduced from the left, i.e. into segment 1 at t=0 (not shown). Subsequently ions flow into all segments; after 3 ms the ion bunch has spread out and extends across the central 5 electrodes as indicated by reference numeral 111. By 7 ms ions have lost some energy, and ions of the ion bunch are collecting in the central (target) segment as indicated by reference numeral 112. At 10 ms the majority of ions of the ion bunch have collected in the target segment as indicated by reference numeral 113. At a certain time later the all ions would have reached thermal equilibrium with the buffer gas filling the trap. This allows for trapping ions with high efficiency into a linear ion trap. The invention is particularly useful when it is necessary that the target segment is at a pressure lower than could be used to trap ions in a single segment trap with high efficiency. By using e.g. five segments to form an extended region one is able to lower the pressure in the target trap by a factor of 5 compared to a single segment trap. A larger number of segments could be employed to attain efficient ion trapping at lower pressures.

The inventors have found that a LIT-TOF instrument constructed using the trapping method as described in U.S. 2010/072362A1 is effective to prepare ions clouds with the necessary properties to achieve good TOF resolving power.

However, one problem observed by the inventors with the trapping method of U.S. 2010/072362A1 is that a relatively large time using a relatively large LIT-TOF is required to trap and cool the ions at a safe operating pressure.

To illustrate this, we note that, for the purpose of LIT-TOF instrumentation a pressure in the target extraction trap of $\sim 1\times10^{-4}$ mbar has been found by the inventors to be adequately low—the inventors have found no substantial advantage to operate at lower pressures in the case of extracting into a TOF of relatively short flight path (though there could be advantage for other types of analyser). Implementing the trapping method of U.S. 2010/072362A1, the inventors have estimated that one must employ ~20 segments to achieve efficient trapping at the operating pressure of $1\times10^{-4}$ mbar, assuming segments having an inscribed radius $r_0$=2.5 mm and a length that is 8 $r_0$. Thus, for a typical $r_0$ of 2.5 mm, the total length of the LIT-TOF would be 400 mm. This is a substantial length, making instrument design inconvenient and expensive. Moreover, the time for ions to cool has been found to be relatively long, such that only a relatively slow scan rate can be achieved. In general, using the method illustrated in FIG. 1, the lower the required target pressure, the longer the cooling time will be, following a linear relation. Note that if the ions are extracted before the cooling process has completed, the inventors would expect a loss of resolving power and transmission in the TOF analyser to result.

U.S. Pat. No. 6,545,268 teaches an alternative method of trapping ions in a linear trap by a method of so called 'dynamic trapping' followed by collisional cooling.

FIGS. 2(*a*)-2(*c*) are simplified drawings of a linear ion trap 202 implementing the principles of U.S. Pat. No. 6,545,268.

The method of U.S. Pat. No. 6,545,268 provides a simple method to prepare a pulse of ions suitable for TOF analysis (see e.g. col. 6 lines 51-53). With reference to FIGS. 2(*a*)-2(*c*), ions are pulsed into the linear ion trap 202 having a buffer gas pressure, from an external source 201. The external ion source may be for example a multipole filled with ions 210. The ions 210 are initially prevented from entering the linear ion trap 202, by a DC voltage applied to the aperture 203, which is at a higher DC voltage than is applied to multipole 201 as shown by the DC voltage profile indicated by reference numeral 205 in FIG. 2(*a*). At some time later the voltage applied to aperture 203 is made lower than the voltage applied to multipole 201, as shown by the DC voltage profile indicated by reference numeral 206 in FIG. 2(*b*). Some of the ions in multipole 201 pass into the linear ion trap 202. Ions will pass into 202 and be reflected from the aperture 204, due to the electrical potential resulting from the voltage applied to it, which remains higher than the voltage applied to 202. Before any ions have time to pass back through aperture 203, the voltage applied to 203 is raised to prevent ions escaping, as shown by the DC voltage profile indicated by reference numeral 207 in FIG. 2(*c*). Ions are thereby trapped in linear ion trap 202, and reflect back and forth between apertures 203 and 204. After further time the ions have collisions with the buffer gas contained within 202. The pressure of the buffer gas within ion trap 202 will determine the length of time necessary for the trapped ions to reach a thermal equilibrium with the buffer gas. The lower the pressure the longer times is needed for ions to lose their energy and reach a thermal equilibrium with the buffer gas.

U.S. Pat. No. 6,545,268 has similar problems to those described above with reference to U.S. 2010/072362A1, although these are more severe and with additional issues of mass discrimination. In particular, a relatively long period of time is required to cool the ions following trapping within the linear ion trap 202 (as for U.S. 2010/072362A1). Mass discrimination arises due to the fact that ions with lower m/z values have higher velocity than those with higher m/z, and hence enter and reflect back from the aperture 204 more quickly than those with higher m/z. The ratio of the highest and lowest m/z ion which may be trapped effectively in this manner is hence defined by the length of the linear ion trap 202 and the energy at which ions are admitted to the linear ion trap 202. In practical situations, this length and energy combination for the apparatus shown in FIGS. 2(*a*)-2(*c*) are likely to limit the ratio to perhaps ~3: For example, if the lowest m/z ion trapped is m/z 50, then the highest m/z ion which may be trapped might be m/z 150. The range which may be trapped may be altered by altering the time for which the low voltage is applied to aperture 203, but each fill of the linear ion trap 202 would trap ions which exhibit a considerably lower mass range than the maximum which might be trapped by a linear ion trap (for example, a mass range of 10 or more times may be achievable).

In view of the above considerations, the inventors believe it may be desirable to devise an ion trap, preferably a linear ion trap, capable of trapping ions efficiently whilst cooling them quickly to be in thermal equilibrium with a buffer gas contained within the linear ion trap, whilst the gas pressure existing in the target segment is typically less than $5\times10^{-4}$ mbar and more preferably less than $2\times10^{-4}$ mbar.

The present invention has been devised in light of the above considerations.

SUMMARY OF THE INVENTION

A first aspect of the invention may provide:

An ion trap having:

a segmented electrode structure having a plurality of segments consecutively positioned along an axis, wherein each segment of the segmented electrode structure includes a plurality of electrodes arranged around the axis;

a first voltage supply configured to operate in a radially confining mode in which at least some electrodes belonging to each segment are supplied with at least one AC voltage waveform so as to provide a confining electric field for radially confining ions within the segment;

a second voltage supply configured to operate in a trapping mode in which at least some of the electrodes belonging to the segments are supplied with different DC voltages so as to provide a trapping electric field that has an axially varying profile for urging ions towards and trapping ions in a target segment of the plurality of segments;

a first chamber configured to receive ions from an ion source, wherein a first subset of the segments are located within the first chamber;

a second chamber configured to receive ions from the first chamber, wherein a second subset of the segments are located within the second chamber, and wherein the target segment is one of the second subset of segments;

a gas pump configured to pump gas out from the second chamber so as to provide the second chamber with a lower gas pressure than the first chamber;

a gas flow restricting section located between the first chamber and second chamber, wherein the gas flow restricting section is configured to allow ions to pass from the first chamber to the second chamber whilst restricting gas flow from the first chamber to the second chamber.

In this way, ions can be brought towards thermal equilibrium ("thermalised"), and are preferably cooled, by the first subset of segments in a relatively high pressure environment (the first chamber) as they are moved towards a target segment in a relatively low pressure environment (the second chamber), e.g. so that the ions can subsequently be extracted from the target segment in the relatively low pressure environment thereby avoiding the problems typically associated with extracting ions from a relatively high pressure environment.

The axis may be a linear axis, in which case the ion trap may be referred to as a linear ion trap. However, the axis could be curved in some cases.

The gas flow restricting section may include a wall between the first chamber and the second chamber, with at least one aperture (preferably a single aperture) being formed in the wall to allow ions to pass from the first chamber to the second chamber whilst restricting gas to flow from the first chamber to the second chamber.

The at least one aperture in the wall of the gas flow restricting section may house one or more segments of the plurality of segments. In this way, ions can be radially confined by as they pass through the aperture of the gas flow restricting section.

The one or more segments housed by the aperture in the wall of the gas flow restricting section may be referred to as "gas flow restricting segment" or "gas flow restricting segments" for brevity.

The/each gas flow restricting segment preferably has an inscribed radius that is smaller than the inscribed radius of a segment that is located entirely in the first or second chamber (noting that a gas flow restricting segment may be partially located in the first or second chamber, see e.g. FIG. 3(*a*)).

For a segment of the ion trap for which the electrodes arranged around the axis of the ion trap are equally spaced from the axis of the ion trap (as is usual for a multipole ion guide), the term "inscribed radius" (which may be referred to as $r_0$) may be defined as the radius of a circle that is perpendicular to the axis of the ion trap, contained within the electrodes of the segment, and sized so as to touch opposing electrodes of the segment without intersecting any electrodes of the segment.

For a segment of the ion trap for which the electrodes arranged around the axis of the ion trap are not equally spaced from the axis of the ion trap (e.g. because electrodes are spaced from the axis of the ion trap further in a first direction perpendicular to the axis than in a second direction perpendicular to the axis, e.g. wherein the first and second directions may be perpendicular to each other), the term "inscribed radius" (which may be referred to as $r_0$) may be defined as the geometric mean of the shortest distance from the axis to each electrode in the segment (i.e. the geometric mean calculated from the shortest measurable distance from the axis to each electrode in the segment).

The first chamber may include an ion inlet configured to receive ions from an ion source.

The first chamber may include a gas inlet configured to receive a gas (preferably an inert gas) from a first chamber gas supply. Alternatively, the first chamber may be configured to receive a gas from an ion source, e.g. via the ion inlet.

The second chamber may have a pump inlet configured to connect to the gas pump to allow the gas pump to pump gas out from the second chamber. The second chamber may have a gas inlet configured to receive a gas (preferably an inert gas) from a second chamber gas supply. Alternatively (or additionally), the second chamber may be configured to receive a gas from the first chamber, e.g. via the gas flow restricting segment.

The ion trap may be configured (e.g. by appropriately setting one or more gas pumps and/or one or more gas supplies) to provide a predetermined first pressure in the first chamber and a predetermined second pressure in the second chamber, when the ion trap is in use.

As a skilled person would appreciate, the pressure in the first chamber and second chamber would typically vary slightly from location to location, so the ion trap may be configured to provide a predetermined first pressure at a predetermined location in the first chamber and a predetermined second pressure at a predetermined location in the second chamber, when the ion trap is in use.

The pressure at a predetermined location in the first and/or second chamber could be measured using a pressure gauge. However, the pressure at a predetermined location in the first and/or second chamber could be inferred using standard gas conductance calculations. For example, the pressure at a predetermined location in the second chamber could be measured using a pressure gauge, with the pressure at a predetermined location in the first chamber being inferred using standard gas conductance calculations. Commercial software is available for performing calculations, e.g. as was used to obtain the pressures shown in FIG. 7. An example of such software is COMSOL Multiphysics (R).

The predetermined location in the first chamber and/or the predetermined location in the second chamber is preferably on the axis. The predetermined location in the first chamber may be on the axis within a segment located in the first chamber, e.g. a pre-trapping segment (as defined below). The predetermined location in the second chamber may be on the axis within a segment located in the second chamber, e.g. the target segment. Software such as COMSOL Multiphysics (R) may be used to ensure that the pressure gradient is not too large in regions where ions are to be trapped, such as the pre-trapping segment or target segment.

For completeness, we note that achieving a desired predetermined pressure in the first and second chambers using the gas pump and by appropriately designing the gas flow restricting section and other elements of the ion trap would be well within the capability of a skilled person.

For example, the first pressure may be achieved by suitably configuring the gas flow restricting section, the first chamber gas supply (if present), the gas inlet in the first chamber (if present), and the ion inlet in the first chamber (if present).

For example, the second pressure may be achieved by suitably configuring the gas pump, the gas flow restricting section, the second chamber gas supply (if present), and the gas inlet in the second chamber (if present).

Preferably, the first pressure is 10 or more (or even 100 or more) times larger than the second pressure, i.e. so there is a large pressure drop between the first chamber and second chamber.

Preferably, the first pressure is $1\times10^{-3}$ mbar or higher, more preferably $5\times10^{-3}$ mbar or higher. The first pressure may be $1\times10^{-1}$ mbar or lower, more preferably $5\times10^{-2}$ mbar or lower.

Preferably, the second pressure is less than $1\times10^{-3}$, more preferably less than $5\times10^{-4}$ mbar and is more preferably less than $2\times10^{-4}$ mbar. The second pressure may be $1\times10^{-5}$ mbar or higher.

The first chamber may be configured to receive (e.g. from the ion source and/or a first chamber gas supply) an inert gas, such as argon. The second chamber may be configured to receive (e.g. from the first chamber and/or a second chamber gas supply) an inert gas, such as argon.

The first chamber may be configured to receive (e.g. from the ion source and/or a first chamber gas supply) a gas that has been cooled below room temperature, e.g. through operation of a cooling apparatus. The second chamber may be configured to receive (e.g. from the first chamber and/or a second chamber gas supply) a gas that has been cooled below room temperature, e.g. through operation of a cooling apparatus. Cooling the gas received by the first and/or second chambers ought to provide enhanced performance, but would add complexity and cost, and the inventors have found that performance improvements can be obtained using the invention even if the gas received by the first and second chambers is not cooled.

Preferably, some (preferably all) of the segments have length (L)/inscribed radius ($r_0$)) ratio ($L/r_0$)) of between 1 and 10. Not all segments need have the same ($L/r_0$). Length may be measured with respect to the axis (around which the electrodes of the segments are arranged).

The inscribed radius $r_0$ of segments other than any segments in the gas flow restricting segment could be in the range 0.5 mm to 10 mm.

The inscribed radius $r_0$ of any gas flow restricting segment could be in the range 0.25 mm to 5 mm (preferably half or less than half of the inscribed radius of one of the other segments, though other ratios are possible).

The plurality of electrodes in at least one (preferably each) segment may include a number of elongate electrodes which extend in the direction of the axis and are arranged to form a multipole ion guide. The elongate electrodes arranged to form a multipole ion guide may take the form of rods, e.g. hyperbolic rods. Other rod forms are possible, as would be appreciated by a skilled person.

The first voltage supply may be configured to operate in a radially confining mode in which the elongate electrodes arranged to form a multipole ion guide in each segment are supplied with at least one AC voltage waveform so as to provide the confining field. The at least one AC voltage waveform may be an RF voltage waveform. Techniques for supplying the elongate electrodes of a multipole ion guide with at least one AC voltage waveform to provide an electric field for radially confining ions are well known. Typically, these techniques involve supplying different phases of the same AC voltage waveform to different electrodes of the multipole ion guide.

The plurality of electrodes in a gas flow restricting segment may include a number of elongate electrodes which extend in the direction of the axis and are arranged to form a multipole ion guide. Spaces between adjacent pairs of elongate electrodes of a gas flow restricting segment may be filled by elongate electrically insulating members which extend in the direction of the axis, e.g. so that the elongate electrodes and elongate insulating members form a tube which extends circumferentially around the axis for restricting gas from flowing radially outwards from the gas flow restricting segment. The elongate insulating members may help to electrically insulate the electrodes of the gas flow restricting segment from each other. A gas flow restricting segment may include an electrically insulating tube or shell which surrounds the electrodes (and if present the insulating members) for restricting gas flow radially outwards from the gas flow restricting segment.

Preferably, the distance between the target segment in the second chamber and a last segment in the first chamber is 40 $r_{0t}$ or less, more preferably 20 $r_{0t}$, or less, more preferably 12 $r_{0t}$ or less, more preferably 9 $r_{0t}$ or less, more preferably 6 $r_{0t}$ or less, where $r_{0t}$ is the inscribed radius of the target segment, and the distance is measured along the axis, e.g. from a centre of the target segment to a centre of the last segment in the first chamber. In this way, ions can be transferred from the last segment in the first chamber to the target segment with minimal energy change. The last segment in the first chamber may be defined as the segment closest to the second chamber that is located entirely in the first chamber (noting that, for example, there could be a segment located in the gas flow restricting section that is partially, rather than entirely, located within the first chamber, see e.g. FIG. 3). The last segment in the first chamber could be the pre-trapping segment referred to below.

The first voltage supply may be configured to operate in an extraction mode in which an AC voltage waveform supplied to electrodes of the target segment in the radially confining mode are paused or stopped so as to allow ions to be extracted from the target segment. In the extraction mode, the AC voltage waveform supplied to electrodes of segments other than the target segment may continue in the same manner as in the radially confining mode.

The ion trap may include a third voltage supply configured to operate in an extraction mode in which one or more extraction voltages are supplied to one or more electrodes of the target segment and/or one or more extraction electrodes, preferably whilst the first voltage supply is operating in its extraction mode, to extract ions located in the target segment out of the ion trap, e.g. towards a mass analyser.

For the avoidance of any doubt, the first voltage supply, second voltage supply and third voltage supply may be separate units or integral with each other. Any of the first, second and third voltage supplies may include a number of individual supplies.

Also for avoidance of any doubt, the same electrodes in each segment may be supplied with AC and DC voltages by the first and second voltage supplies, respectively. Alternatively, the first voltage supply may be configured to supply AC voltages to a first subset of electrodes in each segment, with the second voltage supply being configured to supply DC voltages to a second subset of electrodes in each segment.

The second voltage supply may be configured to operate in the trapping mode so that there are at least some pairs of adjacent segments for which there is a small DC offset between a DC voltage applied to at least one electrode in a first segment of the pair and a DC voltage applied to at least one electrode in a second segment of the pair. A small DC offset in this context is preferably 2 V or less, more preferably 1 V or less, more preferably 0.5 V or less, more preferably 0.25 V or less, and may be 0.05 V or higher.

In this way, i.e. by having small DC offsets between at least some pairs of adjacent segments in the trapping mode, the trapping electric field can urge ions towards the target segment without those ions gaining significant kinetic energy (which increased kinetic energy may require additional time for the ions to be brought back towards thermal equilibrium). Note that some pairs of adjacent segments may have large DC offsets in the trapping mode, e.g. to provide a potential barrier to stop exiting a downstream end of the ion trap.

The second voltage supply may be configured to operate in a thermalisation mode in which at least some of the electrodes belonging to the segments are supplied with different DC voltages so as to provide a thermalisation electric field that has an axially varying profile for trapping ions in the target segment located within the second chamber whilst preventing further ions from entering the target segment, e.g. to allow thermalisation of the ions trapped in the target segment through collisions with gas particles, e.g. prior to those ions being extracted from the target segment.

In this way, any energy gained by the ions as they are moved into the target segment by the trapping electric field can be thermalised/cooled away, e.g. prior to those ions being extracted from the target segment.

The ions trapped in the target segment are preferably cooled by collisions with gas particles, in which case the thermalisation mode may be referred to as a "cooling mode" and the thermalisation electric field may be referred to as a "cooling electric field" (noting that any thermalisation/cooling would in general be done by collisions with gas particles, rather than by the electric field itself—as noted below, "cooling" and "thermalisation" when used to describe an "electric field" are being used simply as a label to distinguish the electric field from other electric fields described herein).

The second voltage supply may be configured to operate in a pre-trapping mode in which at least some of the electrodes belonging to the segments are supplied with different DC voltages so as to provide a pre-trapping electric field that has an axially varying profile for urging ions towards and trapping ions in a pre-trapping segment located within the first chamber, e.g. prior to those ions being urged towards and trapped in the target segment located in the second chamber by the trapping electric field.

There are preferably 5 or fewer segments between the pre-trapping segment and the target segment, more preferably 4 or fewer segments between the pre-trapping segment and the target segment, more preferably 3 or fewer segments between the pre-trapping segment and the target segment, more preferably 2 or fewer segments between the pre-trapping segment and the target segment, more preferably 1 segment between the pre-trapping segment and the target segment. This helps to allow transfer of ions from the pre-trapping segment to the target segment with minimal energy change.

In this way, ions can be "pre-trapped" in the pre-trapping segment located within the first chamber, before being urged towards and trapped in the target segment located in the second chamber.

The pre-trapping segment located within the first chamber is preferably a last segment in the first chamber, wherein the last segment in the first chamber may be defined as the segment closest to the second chamber that is located entirely in the first chamber (noting that, for example, there could be a segment located in the gas flow restricting section that is partially, rather than entirely, located within the first chamber, see e.g. FIG. 3). In other words, the pre-trapping segment is preferably the segment in the first chamber that is closest to the second chamber.

The trapping electric field (produced in the trapping mode) may include a potential barrier that is upstream of the pre-trapping segment (i.e. closer to the ion source than the pre-trapping segment) for preventing ions from the ion source that haven't yet been trapped in the pre-trapping segment from being moved into the target segment when the second voltage supply is operating in the trapping mode, see e.g. potential barrier 1360*a* indicated in the DC voltage profile indicated by reference numeral 1360 in FIG. 13.

The second voltage supply may be configured to operate in the pre-trapping mode so that there are at least some pairs of adjacent segments for which there is a small DC offset between a DC voltage applied to at least one electrode in a first segment of the pair and a DC voltage applied to at least one electrode in a second segment of the pair. A small DC offset in this context is preferably 2 V or less, more preferably 1 V or less, and may be 0.05 V or higher.

In this way, i.e. by having small DC offsets between at least some pairs of adjacent segments in the pre-trapping mode, ions can be urged towards the pre-trapping segment without gaining significant kinetic energy (which would need to be thermalised away, lengthening the cooling time and reducing the scan rate). Note that some pairs of adjacent segments may have large DC offsets in the pre-trapping mode, e.g. to provide a potential barrier to stop ions from entering the second chamber from the first chamber.

In other embodiments, there may be larger DC offsets between adjacent segments in the pre-trapping mode, e.g. since if the pressure were adequately high in the pre-trapping segment then thermalisation in the pre-trapping segment may be adequately fast without the need to avoid giving ions entering the pre-trapping segment significant kinetic energies. Having small DC offsets between adjacent segments is therefore considered to be more useful in the trapping mode (than in the pre-trapping mode), since in the trapping mode ions gaining kinetic energy may take longer to thermalise due to the relatively low pressure in the second chamber.

The second voltage supply may be configured to operate in a pre-thermalisation mode in which at least some of the electrodes belonging to the segments are supplied with different DC voltages so as to provide a pre-thermalisation electric field that has an axially varying profile for trapping ions in the pre-trapping segment located within the first chamber whilst preventing further ions from entering the pre-trapping segment, e.g. to allow thermalisation of the ions trapped in the pre-trapping segment through collisions with gas particles, e.g. prior to those ions being urged towards and trapped in the target segment located in the second chamber by the trapping electric field. The axially varying profile of the pre-thermalisation electric field may include a potential barrier which prevents further ions from entering the pre-trapping segment. Note that the further ions prevented from entering the pre-trapping segment need not be lost, but may be stored or trapping in an upstream segment, e.g. in front of the potential barrier.

The ions trapped in the pre-trapping segment are preferably cooled by collisions with gas particles, in which case the pre-thermalisation mode may be referred to as a "pre-cooling mode" and the pre-thermalisation electric field may be referred to as a "pre-cooling electric field" (noting that any thermalisation/cooling would be done by collisions with gas particles, rather than by the electric field itself).

The second voltage supply may be configured to operate in the pre-trapping mode at the same time as the thermalisation mode, since a DC voltage profile can be defined which serves as both a "pre-trapping" electric field and a "thermalisation" electric field thereby allowing "pre-trapping" to be performed at the same time as "thermalisation", see e.g. the DC voltage profile indicated by reference numeral 1361 in FIG. 13.

The second voltage supply may be configured to operate in the pre-thermalisation mode at the same time as the thermalisation mode, since a DC voltage profile can be defined which serves as both a "pre-thermalisation" electric field and a "thermalisation" electric field which allows "pre-thermalisation" to be performed at the same time as "thermalisation", see e.g. the DC voltage profile indicated by reference numeral 1341 in FIG. 13.

For avoidance of any doubt, when an adjective such as "trapping", "pre-trapping", "thermalisation", "cooling", "pre-thermalisation" or "pre-cooling" is used in connection with an electric field, the use of the adjective is simply to provide the electric field being described with a label to allow that electric field to be distinguished from other electric fields described herein.

The ion trap is preferably configured to repeatedly perform an extraction cycle that includes:

- the second voltage supply operating in the trapping mode for a first predetermined period of time to move ions towards and trap ions in the target segment;
- the first and third voltage supplies operating in their extraction modes to extract ions from the target segment out of the ion trap, e.g. towards a mass analyser.

For avoidance of any doubt, the extraction of ions from the target segment may be initiated/performed whilst the second voltage supply is operating in the trapping mode, or during some other part of the extraction cycle.

The extraction cycle preferably includes:

- the second voltage supply operating in the pre-trapping mode for a second predetermined period of time; and/or
- the second voltage supply operating in the thermalisation mode for a third predetermined period of time.

More preferably, the extraction cycle includes:

- the second voltage supply operating in the pre-trapping mode for a second predetermined period of time; and
- the second voltage supply operating in the thermalisation mode for a third predetermined period of time.

The extraction cycle may further include:

- the second voltage supply operating in the pre-thermalisation mode for a fourth predetermined period of time For avoidance of any doubt, the first, second, third and fourth periods (if present) of time need not occur in succession, but could overlap with each other and could be performed in any order.

For example, as noted above, the pre-trapping mode and the pre-thermalisation mode may be performed at the same time as the thermalisation mode (though preferably not the same time as each other). Accordingly, the second and/or fourth predetermined periods of time may overlap with (and preferably fall entirely within) the third predetermined period of time.

The first period of time may, for example, be from 0.1 ms to 100 ms or longer.

The first period of time may be from 0.25 ms to 10 ms.

The second period of time may, for example, be from 0.1 ms to 100 ms or longer.

The second period of time may be from 0.25 ms to 10 ms.

The third period of time may, for example, be from 0.5 ms to 10 ms or longer.

The third period of time may be from 1 ms to 3 ms.

The fourth period of time may, for example, be from 0.5 ms to 10 ms or longer.

The fourth period of time may be from 1 ms to 3 ms.

The ion processing device may include extraction electrodes configured to extract ions from the target segment located in the second chamber when at least one extraction voltage is supplied thereto.

In a second aspect, the invention provides a mass analysis apparatus having:

an ion source;

an ion trap according to the first aspect of the invention, wherein the first chamber of the ion trap is configured to receive ions from the ion source;

a mass analyser for analysing ions extracted from the target segment of the ion trap.

The ion source may be configured to provide a continuous stream of ions to be received by the first chamber of the ion trap. The ion source could, for example, include a collision chamber, a pre-filter, a mass filter, an ion mobility filter, a differential mobility filter, multipole devices, ion funnels or other appropriate ion processing apparatus.

The mass analyser could be, for example, a time-of-flight mass analyser, a mass separator, a linear ion trap ("LIT") operated in a mass selective mode, an electrostatic ion trap or a Fourier transform mass spectrometer.

If the mass analyser is a time-of-flight mass analyser, and the ion trap is a linear ion trap, then the apparatus could be referred to as a linear ion trap time-of-flight mass spectrometer ("LIT-TOF").

The ion trap and/or mass analysis apparatus may include a control unit configured to control the ion trap and/or mass analysis apparatus to perform as described herein.

In a third aspect, the invention provides a method of operating an ion trap according to the first aspect of the invention or a mass analysis apparatus according to the second aspect of the invention.

The method may include any method step implementing or otherwise corresponding to any apparatus feature described in connection with any above aspect of the invention.

The invention also includes any combination of the aspects and preferred features described except where such a combination is clearly impermissible or expressly avoided.

BRIEF DESCRIPTION OF THE DRAWINGS

Examples of these proposals are discussed below, with reference to the accompanying drawings in which:

FIG. 3(*b*) shows elongate electrodes of the linear ion trap of FIG. 3(*a*) in cross-section.

FIG. 3(*c*) shows elongate electrodes of the linear ion trap of FIG. 3(*a*) in cross-section.

FIG. 3(*d*) shows a gas flow restricting segment of the linear ion trap of FIG. 3(*a*) in cross-section.

DETAILED DESCRIPTION

Figure 1:
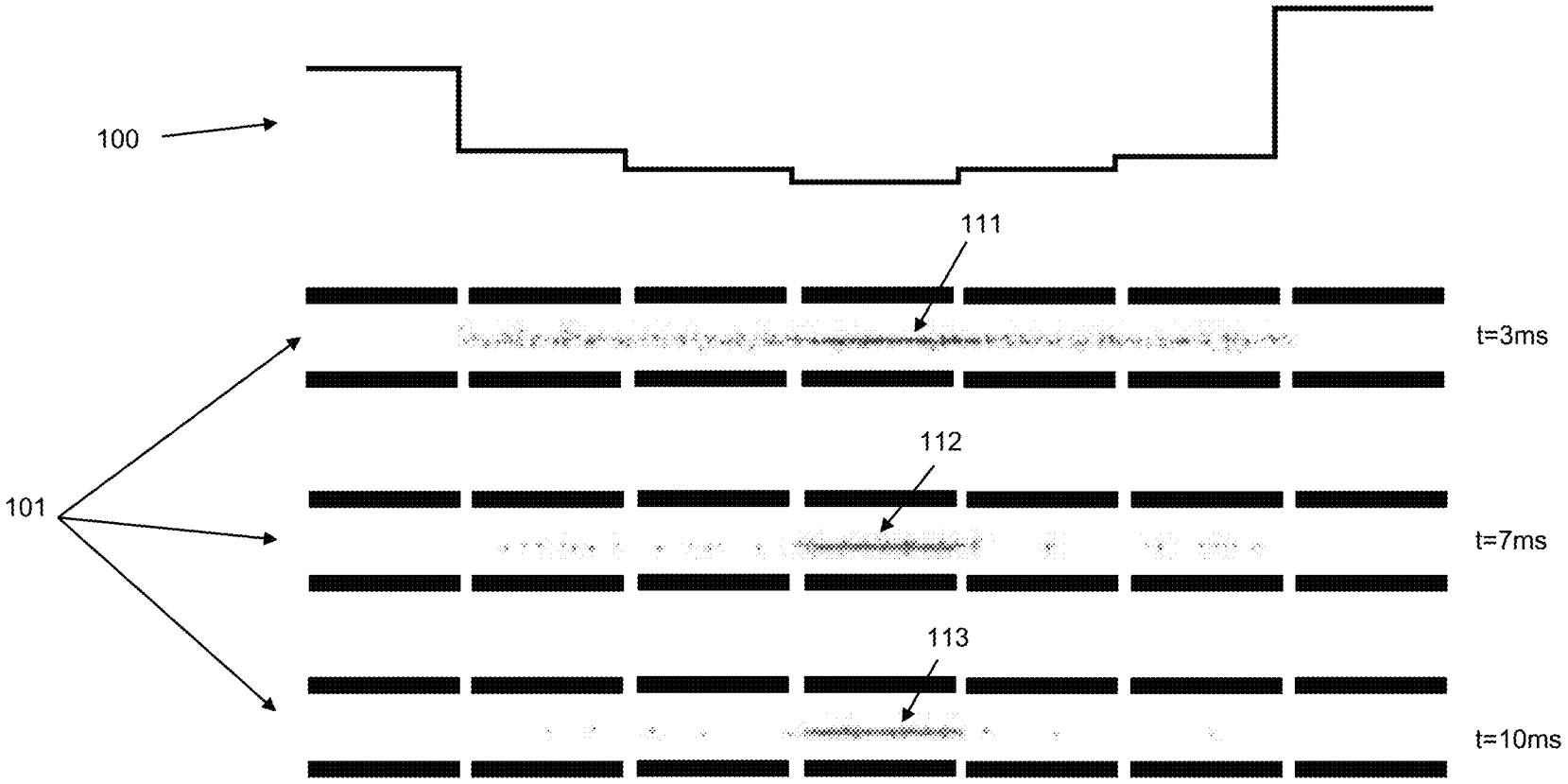
FIG. 1 is a simplified drawing of a linear ion trap implementing the principles of U.S. 2010/072362A1.
Figures 2A, 2B, 2C:
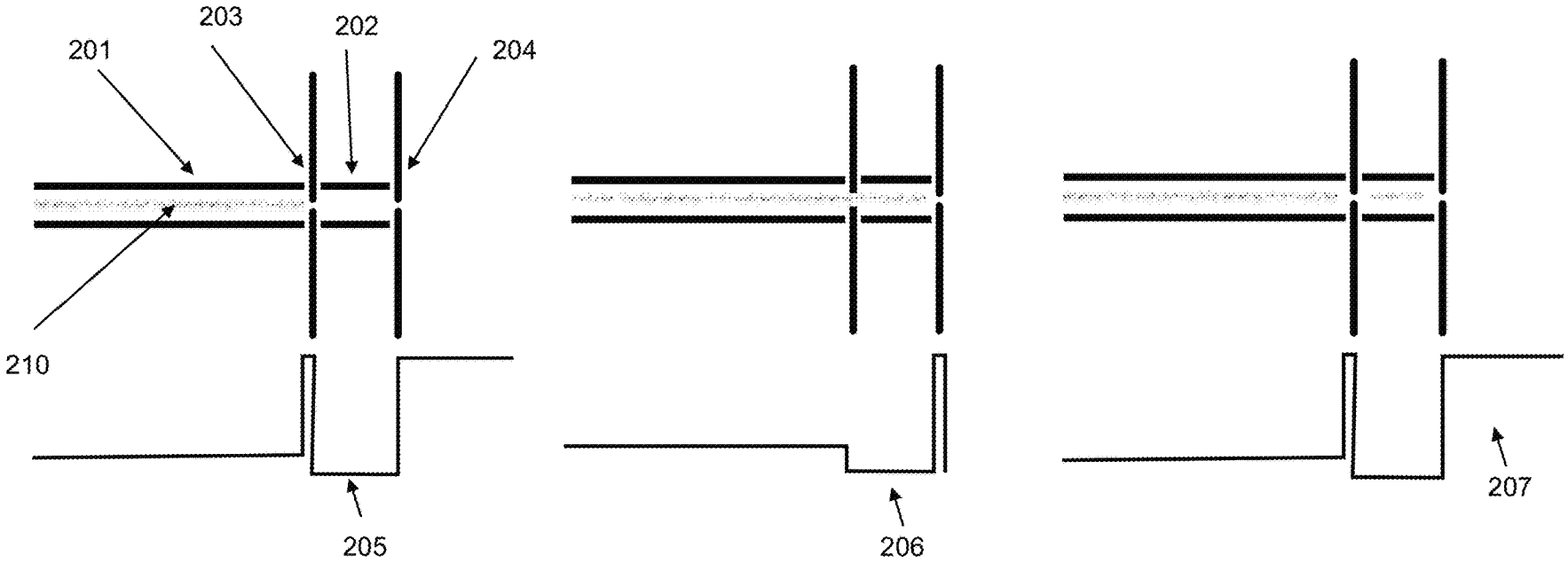
FIGS. 2(*a*)-2(*c*) are simplified drawings of a linear ion trap implementing the principles of U.S. Pat. No. 6,545,268.

The inventors noticed that if ions are transferred between segments of a linear ion trap using very low potential offsets between segments, then they need not regain significant energy during the transfer processes. Consequently, ions may enter a low-pressure region with low average energy, and they can thus be trapped substantially more efficiently than conventional methods and re-cooled to thermal energy more quickly. Simulations were first undertaken and then a prototype instrument was constructed.

To facilitate the fast transfer of ions between linear ion trap segments, the inventors have found it is preferable to maintain the length of the linear ion trap segments as short, and typically less than 8 $r_0$, preferably 6 $r_0$ and most preferably 4 $r_0$, where $r_0$ is inscribed radius of the segments. This allows for ions to be transferred from one segment to another quickly and without introducing significant kinetic energy to the ions. Thus ions may be moved between segments by applying a small DC offset, typically less than 1 V and preferably less than 0.5 V and preferably less than 0.25 V.

In the examples set out herein, we describe a segmented linear ion trap, wherein at least one segment of the segmented linear ion trap is located in a high-pressure first chamber and at least one segment including a target segment is located in a low-pressure second chamber. The high-pressure first chamber may be considered as being located 'up stream' of the low-pressure second chamber and may have an ion inlet end for receiving ions from an ion source. The low and high pressure chambers may have a gas flow restricting section located between them, to restrict the flow of gas therebetween. The gas flow restricting section may also be referred to herein as a conductance limiting section, since it preferably has a fluid conductance that is adequately small to achieve a desired pressure differential between the low and high pressure chambers. An overview of fluid conductance, which is a well-known property, can be found in the Annex, below.

The gas flow restricting section may include at least one ion trap segment with a reduced $r_0$ compared to the other segments of the segmented linear ion trap. The gas flow restricting section is preferably effective to establish a desired pressure differential between the low and high pressure chambers. The gas flow restricting section may be formed within a chamber wall so that gas passing from the high-pressure region to the low-pressure region must pass through the gas flow restricting section. The gas flow restricting section may be formed so that together the electrodes and the insulating support structure are formed into a tube, with the gas flow restricting section being the only means of fluid communication between the first and second chambers. The high pressure first chamber preferably has a constant supply of gas and preferably the low pressure second chamber may be in communication with a pump, preferably a turbomolecular pump.

It may be further advantageous to minimize the distance (and the number of segments) between the last segment in the first chamber (e.g. the pre-trapping segment) and the target segment in the low pressure second chamber to allow faster transfer of ions and to maintain the energy imparted to the ions to a minimum.

The high pressure in the high-pressure first chamber may be set to efficiently trap and cool ions with a short cooling time.

Here, cooling time may refer to the time for ions to attain a thermal energy or near thermal energy. Thermal energy means specifically that ions substantially reach/establish a thermal equilibrium with the buffer gas and thus share a common temperature. More specifically, collectively a group or bunch of ions have a Root Mean Square (RMS) energy of ~3 KT/2, where T is the buffer gas temperature and K is Boltzmann's constant. At room temperature KT has a value of 0.025 eV.

In an ion trap as exemplified herein, the cooling time in the low-pressure second chamber may be in the range of several milliseconds down to fractions of a millisecond, and typically 20 ms to 0.25 ms according to the ion's mass and collision cross section, and gas pressure.

In one mode of operation disclosed herein, ions may pass through the high-pressure first chamber, through the gas flow restricting section and be trapped directly in the target segment in the low-pressure region. In this mode of operation, the pressure in the first chamber is preferably adequately high to cool the ions and maintain them substantial cooled during the transport through the high-pressure first chamber.

In another mode of operation disclosed herein, ions may be pre-trapped in a pre-trapping segment in the high-pressure first chamber, allowed to cool and then be transported from the high-pressure first chamber to the low-pressure second chamber by applying small potential DC offset(s) (to urge the ions from the high-pressure first chamber through the conductance limiting section) and then re-trapped within the target segment in the low-pressure second chamber. Ions can then be quickly re-cooled in the second chamber before being extracted to a TOF analyser.

In combination, the use of small DC offset(s) and the presence of the high-pressure first chamber in close proximity to the low-pressure second chamber within a segmented linear ion trap allows for the efficient trapping of ions in a low-pressure ion trap with the combination of high efficiency and fast cooling time, where the quantity of $1/(P \cdot t)$ where P=pressure of the region from which ions are trapped and extracted and t=cooling time, is lower than is possible in prior art devices. The device can also be made compact and with fewer segments than in prior devices.

Figures 3A, 3B, 3C, 3D:
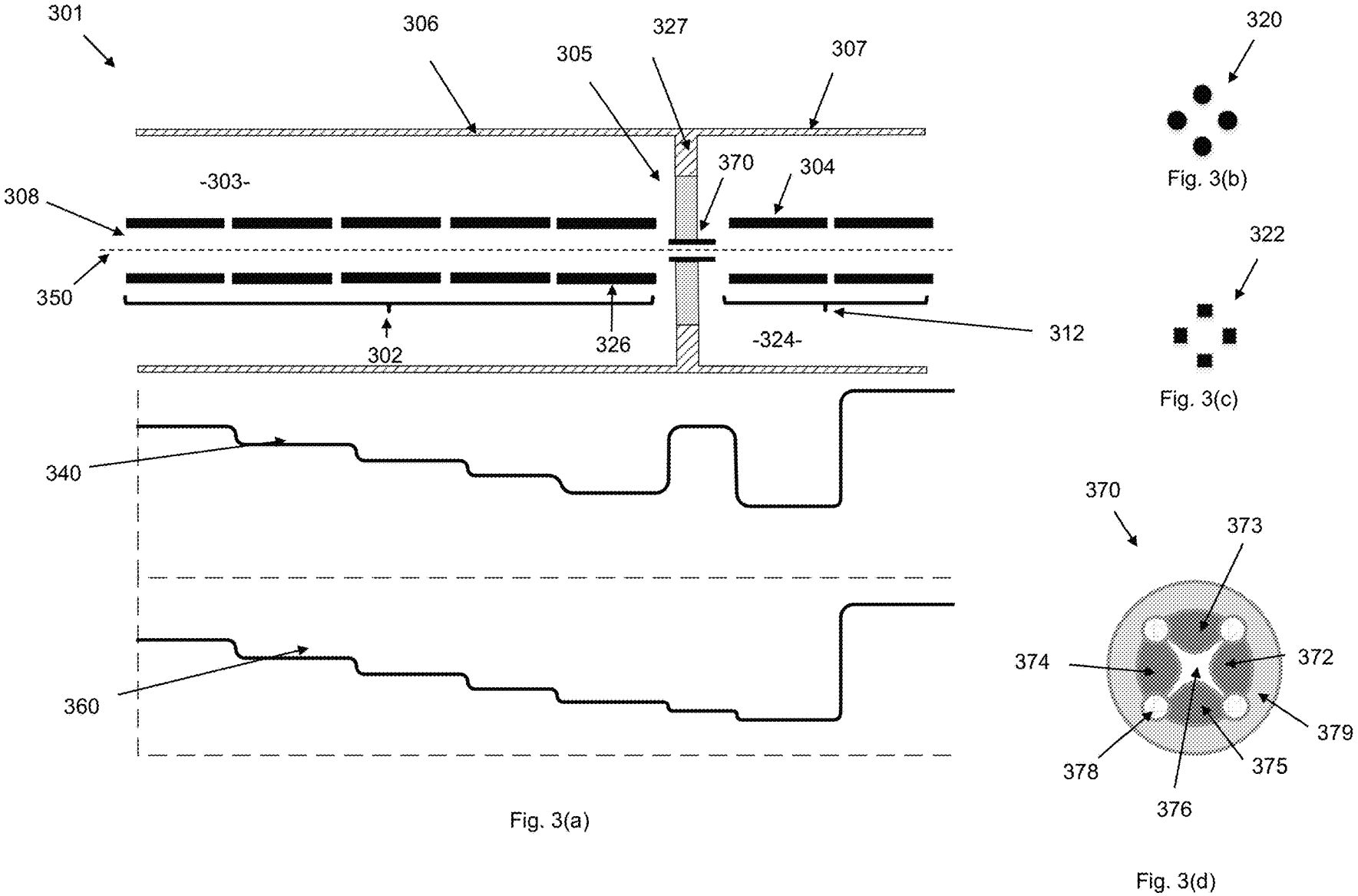
FIG. 3(*a*) shows an example linear ion trap according to the invention.

FIG. 3(*a*) shows an example linear ion trap 301 according to the invention.

The linear ion trap 301 has a segmented electrode structure having a plurality of segments (in this example eight segments) consecutively positioned along a linear axis 350, wherein each segment of the segmented electrode structure includes a plurality of electrodes arranged around the axis. The ion trap 301 may therefore be referred to as a segmented linear ion trap.

A first chamber 303 includes a first subset 302 of the segments (in this example five segments). A second chamber 324 includes a second subset 312 of the segments (in this example two segments).

A gas pump (not shown) for pumping gas out from the second chamber 324 may be used so as to provide the second chamber 324 with a lower pressure than the first chamber 303. A gas supply (not shown) may be provided for supplying a buffer gas to the second chamber 324, e.g. so as to achieve a desired pressure in the second chamber 324 (which may be more challenging to achieve with a gas pump alone).

The first chamber 303 is partly defined by a chamber wall 306. The second chamber 324 is partly defined by chamber wall 307.

In this example, each segment of the linear ion trap 301 includes four elongate electrodes which extend in the direction of the axis 350 and are arranged to form a quadrupole ion guide. The elongate electrodes are preferably rods which have a hyperbolic surface when viewed in cross-section, but could also have a round cross-section 320 as shown in FIG. 3(*b*) or a square cross-section 322 as shown in FIG. 3(*c*). Other electrode shapes are possible and known in the art.

The $r_0$ (inscribed radius) of segments in the first and second subsets 302, 312 may be 2.5 mm, for example (smaller and larger values may be used depending on the target mass range, etc).

The second subset 312 of the segments in the second chamber 324 includes a target segment 304 of the plurality of segments.

Segmented ion trap 301 also has a gas flow restricting section 305 located between the first chamber 303 and second chamber 324.

In this example, the gas flow restricting section 305 includes a wall 327 located between the first chamber 303 and the second chamber 324, with a single aperture formed in the wall 327 to allow ions to pass from the first chamber 303 to the second chamber 324 whilst restricting gas flow from the first chamber 303 to the second chamber 324

In this example, the aperture in the wall 327 of the gas flow restricting section 305 houses a segment 370 of the plurality of segments, which will be referred to herein as a gas flow restricting segment 370 for brevity.

As depicted in FIG. 3(*a*), the gas flow restricting segment 370 has an inscribed radius smaller than the inscribed radius, $r_0$ of the other segments, in this case half of the $r_0$ of the segments in the first and second subsets 302, 312.

The gas flow restricting segment 370 is shown in cross section in FIG. 3(*d*) and is formed from four electrodes 372, 373, 374, 375 which extend in the direction of the axis 350 and are arranged to form a quadrupole ion guide. In this example, the electrodes 372-375 have a hyperbolic surface when viewed in cross-section so as to define a hyperbolic electrical potential in the space 376 between the electrodes when the gas flow restricting segment 370 is in use.

Spaces between adjacent pairs of the electrodes 372-375 of the gas flow restricting segment 370 are filled by insulating rods 378 which extend in the direction of the axis 350, so that the elongate electrodes 372-375 and insulating rods 378 of the gas flow restricting segment 370 form a tube which extends circumferentially around the axis 350 for restricting gas flow radially outwards from the gas flow restricting segment 370. The electrodes 372-375 and insulating rods 378 are further surrounded by an insulating tube 379 to further restrict gas flow radially outwards from the interior of the gas flow restricting segment 370.

In this way, the gas flow restricting section is able to restrict gas flow from the first chamber 303 to the second chamber 324. The extent of gas flow restriction provided by the gas flow restricting section may be parameterised using gas conductance, which is discussed in more detail in the Annex, below.

A gas supply (not shown) for supplying buffer gas to the first chamber 303 may be used to establish a pressure in the first chamber 303 through a buffer gas inlet (not shown) in the first chamber 303.

The first chamber 303 may have an ion inlet 308 through which ions are introduced from an ion source (not shown). This inlet 308 may optionally be used for introducing gas in to portion 308 (e.g. instead of having a separate buffer gas inlet).

In the gas flow restricting segment 370 shown in FIG. 3(*d*), insulating rods 378 and insulating tube 379 in combination help to accurately locate the electrodes 372-375 so as to create an accurate potential in the space 376. Other segments of the segmented linear ion trap 301, may be formed using a similar method, or using methods known to those skilled in the art. Since there may be no particular advantage to having the other segments restrict radial gas flow, the insulating rods may be omitted from the other segments (indeed, the insulating rods may be a disadvantage for other segments, where it may be desirable to have good gas conductance between the interior of the rods and a gas pump/gas supply.

In use the gas flow restricting section 305, in combination with the source of buffer gas for supplying the first chamber 303, the source of buffer gas for supplying the second chamber 324 and the gas pump for pumping gas out from the second chamber 324 may be used to achieve a desired pressure differential between the first chamber 303 and the second chamber 324. It is to be noted that a desired pressure differential could be achieved just with careful control of a gas pump for pumping gas out from the second chamber 324.

Gas molecules passing from the high-pressure region to the low-pressure region pass through gas flow restricting segment 370 of the gas flow restricting section 305. Because the gas flow restricting segment 370 is housed by the aperture formed in the wall 327, gas conductance between the first chamber 303 and the second chamber 324 is significantly reduced.

The first subset 302 of segments located in the first chamber 303 can be viewed as being upstream in relation to the second subset 312 of segments located in the second chamber 324, because the first chamber 303 is at a higher pressure than the second chamber 324.

A first voltage supply (not shown) may be configured to operate in a radially confining mode in which the electrodes belonging to each segment are supplied with an AC voltage waveform so as to provide a confining electric field for radially confining ions within the segment.

As noted above, in this example, the four electrodes of each segment are arranged to form a quadrupole ion guide, which is a type of multipole ion guide. As is known in the art, a confining electric field for radially confining ions within a multipole ion guide can be obtained by applying different phases of the same AC (typically RF) voltage waveform to the electrodes of the multipole ion guide, with a first phase of the AC voltage waveform being applied to odd numbered electrodes and a second phase (phase shifted by 180°) of the AC voltage waveform being applied to even numbered electrodes, with electrodes being numbered in ascending numerical order going around the axis of the ion trap (about which the electrodes of the multipole ion guide are arranged).

Thus, in the radially confining mode of the first voltage supply, all segments of the segmented ion trap may have an applied AC (typically RF) voltage effective to confine ions in a radial direction. Techniques for achieving radial confinement using RF voltage waveform(s) are well known in the art and so there is no need to describe in more detail here. But it is noted that the AC voltage waveform(s) applied to the electrodes of the gas flow restricting segment 370 may need to be scaled appropriately if that segment has a reduced $r_0$ compared with segments in the first and second subsets 302, 312.

In this example, a second voltage supply (not shown) is configured to operate in:

- a pre-trapping mode in which at least some electrodes belonging to the segments are supplied with different DC voltages so as to provide a pre-trapping electric field that has an axially varying profile for urging ions towards and trapping ions in a pre-trapping segment 326 located within the first chamber, prior to those ions being urged towards and trapped in the target segment 304 located in the second chamber
- a trapping mode in which at least some electrodes belonging to the segments are supplied with a DC voltage so as to provide a trapping electric field that has an axially varying profile for urging ions towards and trapping ions in a target segment 304 of the plurality of segments As shown in FIG. 3(*a*), of the segments located entirely in the first chamber 303, the pre-trapping segment 326 is closest to the gas flow limiting section 305.

The DC voltages of the pre-trapping mode, i.e. the DC voltages respectively applied to the segments in the pre-trapping mode, are indicated by reference numeral 340 in FIG. 3(*a*).

The DC voltages of the trapping mode, i.e. the DC voltages respectively applied to the segments in the trapping mode, are indicated by reference numeral 360 in FIG. 3(*a*).

The second voltage supply may be configured to repeatedly perform an extraction cycle in which the second voltage supply:

- operates in the pre-trapping mode for a predetermined period of time; and
- operates in the trapping mode for another predetermined period of time.

For avoidance of any doubt, the first and second voltage supply may be separate components or may form part of an integral voltage supply.

With the second voltage supply operating in the pre-trapping mode, ions may enter the ion inlet 308 from an up-stream device substantially continuously to be thermalised, and preferably cooled, by the relatively high-pressure gas within the first chamber 303, whilst being moved from the ion input 308 towards the pre-trapping segment 326 by the DC voltages of the pre-trapping mode indicated by reference numeral 340. The DC voltages of the pre-trapping mode indicated by reference numeral 340 further act to trap ions in the pre-trapping segment 326, where the ions can undergo further thermalisation, and preferably cooling, until the second voltage supply is switched to the trapping mode.

The DC voltages of the pre-trapping mode indicated by reference numeral 340 are preferably defined so that there are only small potential offsets between DC voltages applied to at least some adjacent segments of the segmented ion trap in the first chamber 303, ensuring that ions do not gain significant energy as the ions move towards the pre-trapping segment by passing between segments in the first chamber 303.

The DC voltages of the trapping mode indicated by reference numeral 360 acts to move ions towards and confine ions in the target segment 304.

Here, it is to be noted that the DC voltages of the pre-trapping mode indicated by reference numeral 340 are preferably defined so that there is a potential barrier on either side of the target segment 304, so that the pre-trapping mode is performed simultaneously with a thermalisation mode in which ions trapped in the target segment can be thermalised, preferably cooled, by collisions with gas particles. In this way, one group of ions moved into the target segment during a previous cycle can be thermalised/cooled in, and then extracted from, the target segment, whilst a new group of ions is being "pre-trapped" in the pre-trapping segment 326.

In alternative embodiments (not depicted), the second voltage supply may be configured to only operate in the trapping mode, e.g. such that ions are continuously accumulated in the target segment 304 using the DC voltages of the trapping mode indicated by reference numeral 360. In such embodiments, ions could be periodically extracted from the target segment 304. However, alternating the second voltage supply between voltage profiles, e.g. between the profiles indicated by reference numerals 340, 360, is generally preferred since pre-trapping (and pre-thermalisation, see below) can be performed during thermalisation/extraction of ions in the target segment 304.

Figure 4:
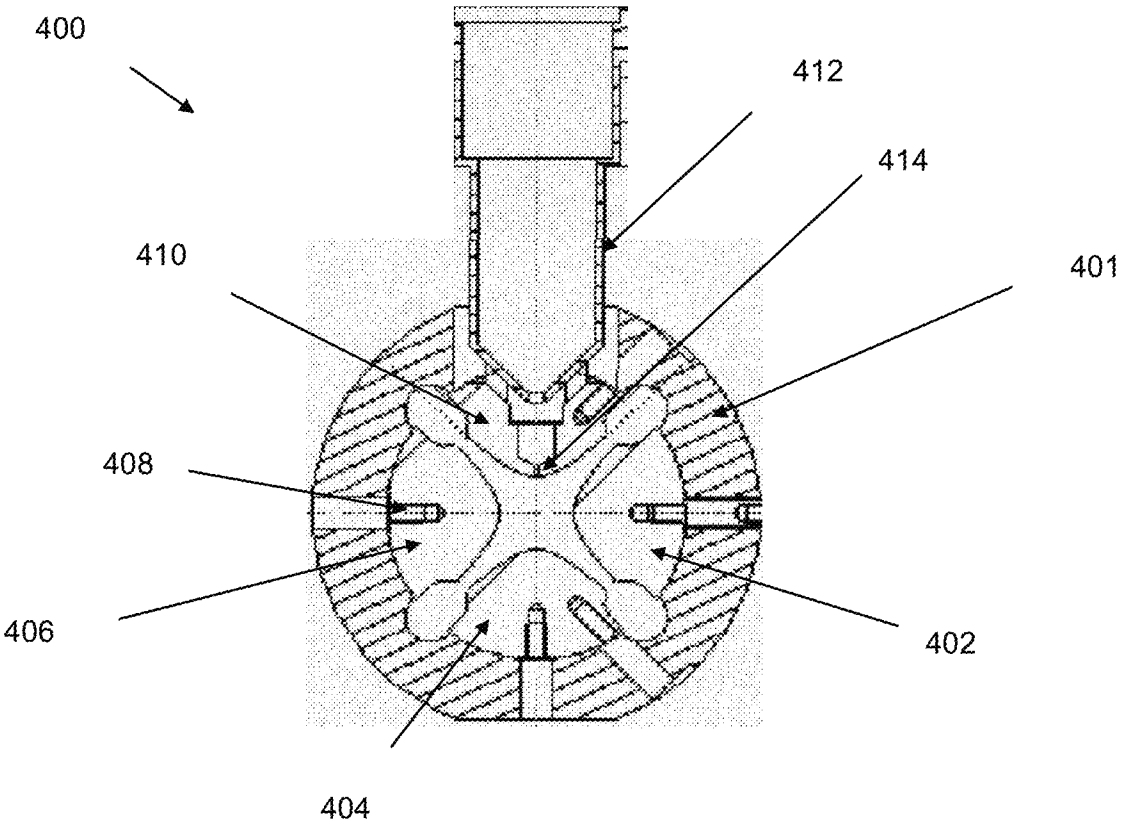
FIG. 4 shows an example target segment for use as a target segment in the linear ion trap of FIG. 3.

FIG. 4 shows an example target segment 400 for use as a target segment in the ion trap 301 of FIG. 3.

The example target segment 400 is configured to extract ions located in the target segment 400 out from the ion trap 301, e.g. into a mass analyser such as a TOF analyser.

As shown in FIG. 4, the target segment 400 has four hyperbolic electrodes 410, 402, 404 and 406.

One electrode 410 of the four electrodes is configured as an extraction electrode and has a slit opening 414 formed within it.

With the first voltage supply operating in the radially confining mode noted above, a first one of the two AC voltage waveforms may be applied to electrodes 406 and 402 with the second one of the two AC voltage waveforms (of opposite polarity, i.e. phase shifted by 180°) may be applied to electrodes 404 and 410.

The first voltage supply may be configured to operate in an extraction mode, in which the AC voltage waveforms supplied to the electrodes of the extraction segment 304, 400 are paused at a predetermined phase (or are otherwise stopped) so as to allow ions to be extracted from the target segment 304, 400. In the extraction mode, the electrodes belonging to each segment other than the extraction segment 304, 400 preferably continue to be supplied with AC voltage waveforms so as to provide a confining electric field for radially confining ions within those segments.

A third voltage supply (which may be the part of or separate from the first and/or second voltage supplies) may be configured to apply one or more extraction voltages to the electrodes of the target segment and/or one or more (additional) extraction electrodes to extract ions through the slit opening 414. An example extraction scheme is described e.g. with reference to FIG. 10 of U.S. 2010/0072362A1. Alternative schemes could easily be envisaged by a skilled person.

It is noted that the polarity of the extraction voltage(s) will in general depend on the polarity of the ions under analysis.

The first, second and third voltage supplies (which as noted above may be separate from each other or part of an integral unit) are preferably controlled by a common control unit.

Also shown in the FIG. 4 is an extraction electrode, in the form of extraction lens element 412, which may be present to accelerate ions to higher energy and to aid focusing of the extracted ion beam. Further extraction electrodes in the form of further lens elements may also present. Electrode elements 410, 402, 404 and 406 may be secured to an insulating ring or shell 401 by screws, e.g. by means of tapped holes 408 in each of the electrodes 402, 404, 406, 410. A high accuracy may be achieved using this and other methods of construction.

Ions extracted from the target segment may be mass analysed.

1) by a resonance ejection scan
2) by a TOF analyser
3) by an electrostatic analyser All these methods benefit from having the ions trapped and cooled in short time.

Figure 5:
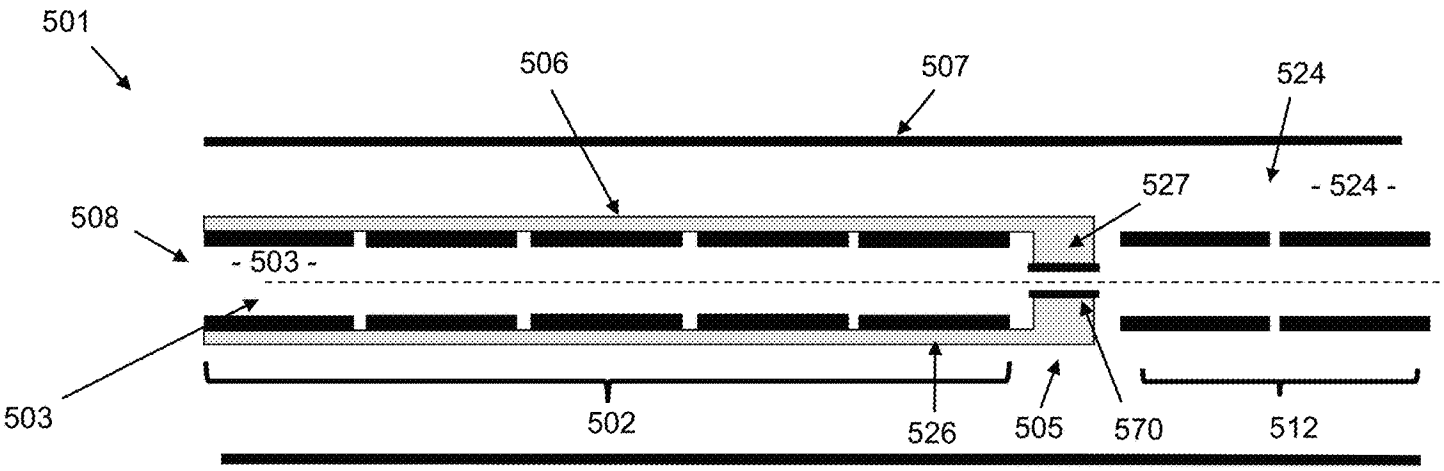
FIG. 5 shows another example linear ion trap 501 according to the invention.

FIG. 5 shows another example linear ion trap 501 according to the invention.

Features of FIG. 5 corresponding to those shown in FIG. 3 have been given alike reference numerals where possible.

Similarly to the ion trap 301 of FIG. 3, the ion trap 501 of FIG. 5 has a first chamber 503 that includes a first subset 502 of segments, a second chamber 524 that includes a second subset 512 of segments, and a gas flow limiting section 505 that includes a gas flow limiting segment 570 housed in a wall 527.

In this example, the first chamber 503 is partly defined by a first tube 506 effective for containing gas flowing under molecular flow conditions, and the gas flow limiting segment 570 is housed by a wall at the end of the first tube 506.

The second chamber 524 is defined by a second tube 507 which contains the first tube 506. A pump (not shown, preferably a turbomolecular pump) is provided for pumping gas out of the second chamber 524.

A gas supply may be provided for establishing a predetermined pressure within the first chamber 503. This pressure may be around $1\times10^{-2}$ mbar. An additional gas supply may be provided for establishing a predetermined pressure within the second chamber 524 (although this could in theory be achieved with just a pump). A high pressure-gradient may be sustained across the gas flow restricting section 505.

An advantage of the example ion trap 501 shown in FIG. 5 over the ion trap 301 shown in FIG. 3 is that chamber 503 need not have an additional pump. This is because, in this example, the lowest pressure (base pressure) which can be achieved in chamber 503 is defined by the pressure of the adjacent chambers 524 and the preceding chamber (if present, not shown). The pressure may, however, be raised above this base pressure by use of an additional gas supply. In general, it is frequently desirable for the first chamber 503 to be held at an elevated pressure, and consequently the lower limitation on pressure is not problematic, whereas the saving of an additional pump can confer a cost advantage.

Figure 6:
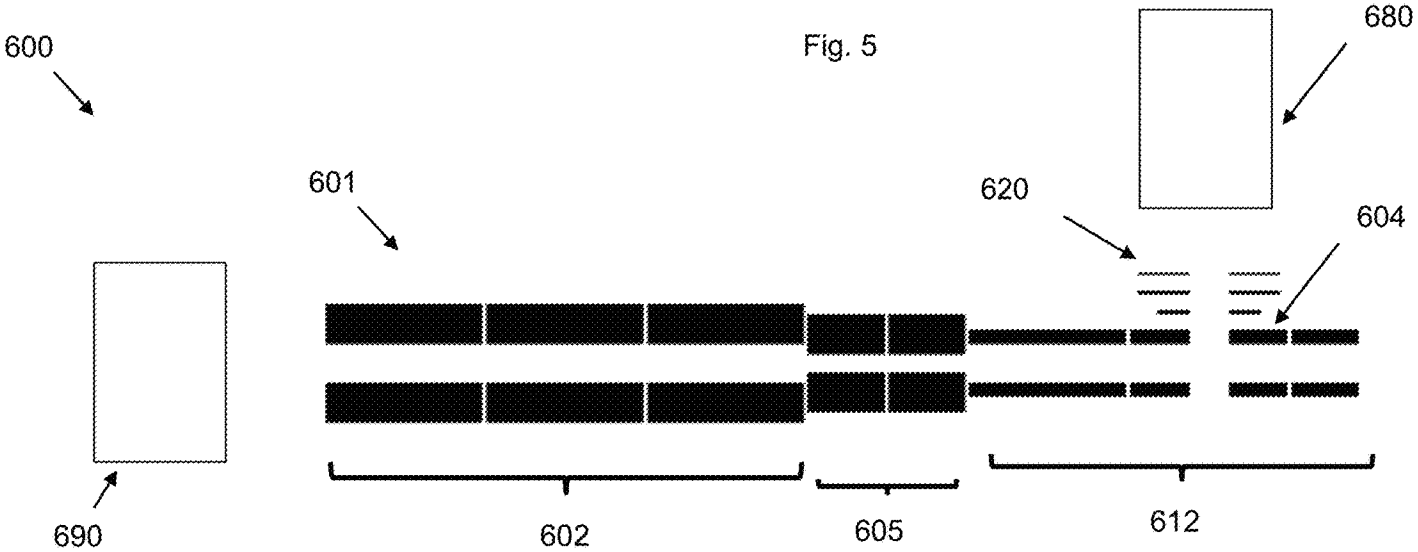
FIG. 6 shows another example linear ion trap 501 according to the invention.

FIG. 6 shows another example linear ion trap 601 according to the invention.

Features of FIG. 6 corresponding to those shown in FIG. 5 have been given alike reference numerals where possible.

In the example ion trap 601 of FIG. 6, the first subset 502 of segments located in a first chamber has three segments, the gas flow restricting section includes two gas flow restricting segments (of reduced $r_0$), and the second subset 612 of segments located in a second chamber has three segments, the middle segment of which is a target segment 604 which may be similar to that described with reference to FIG. 4. Also shown are extraction electrodes 620, which may be used for focusing ions extracted from the target segment 604 towards a TOF mass analyser 680, though other mass analysers could equally be used.

Also shown in FIG. 6 is an ion source 690 configured to provide a continuous supply of ions to the ion trap 601.

The ion trap 601, TOF analyser 680 and ion source 690 together provide a mass analysis apparatus 600.

In other embodiments all electrodes maybe planar electrodes arranged in quadrupolar form.

The example ion traps discussed herein could be used in any application when it is necessary to trap and rapidly cool ions. The ion traps could, for example, be used with a TOF analyser such as that described in U.S. Pat. No. 9,082,602.

Example/Preferred Parameters/Conditions

Some preferred ranges of parameters for an example ion trap are listed. These figures are given for argon gas being used as the buffer gas, for which the inventors have the most experience. The invention could work for other buffer gases however, e.g. helium or nitrogen gas, or other inert gases. The preferred pressure ranges may be different for different gasses and different geometries.

Pressure in the first chamber 303: a typical range of pressures would be $5\times10^{-2}$ to $5\times10^{-3}$ mbar.

Pressure in the second chamber 324: a typical range of pressures would be $1\times10^{-3}$ to $1\times10^{-5}$ mbar.

Performance of the device could be improved were the gas supply to be cooled, though the inventors have found that an adequate cooling effect can be obtained without the need for cooling the gas supply.

The highest pressure that may be operated will be defined by the onset of viscous gas flow.

DC offsets between at least some adjacent segments: preferably 0.05 volt to 2 volts.

Length/inscribed radius ($L/r_0$) of segments: 1 to 10 (not all segments need have the same $L/r_0$).

Inscribed radius $r_0$ of segments other than the gas flow restricting segment: could be in the range 0.5 mm to 10 mm.

Inscribed radius $r_0$ of the gas flow restricting segment: 0.25 mm to 5 mm (preferably half or less than half that of the other segments, though other ratios are possible).

The parameters listed above are interrelated, so the optimum values may vary somewhat according to the target application.

Preferred values may be $r_0$=2.5 mm for segments other than the gas flow restricting segment, $r_0$=1.25 mm for the gas flow restricting section. $L/r_0$=4 for each segment. Pressure in the high-pressure region $2\times10^{-2}$ mbar, pressure in target segment $2\times10^{-4}$ mbar.

Example Modifications

In the example ion trap 601 described above with reference to FIG. 6, the mass analyser described is a single TOF mass analyser 680. However, the invention is applicable to other types of mass analysers and indeed any type of TOF analyser, and especially applicable to high resolving power time-of-flight mass analysers. It is also applicable to electrostatic analysers.

It is to be noted that a mass spectrometer is not a requirement, since the ion trap could be used e.g. with other types of mass analysers, e.g. a mass separator.

Also, it would be possible for the gas flow restricting segment to have the same $r_0$ as the other segments in the first and second chambers. This could be achieved by for example making all segments with $r_0$=1.25 mm, whilst ensuring that the gas conductance between the first chamber and second chamber is adequately low to provide a desired pressure differential between the first and second chambers (e.g. by making the gas flow restricting segment adequately long). This option may be difficult if it was desirable to make a device with segments having a large $r_0$ for other reasons.

Experimental Work

Figure 7:
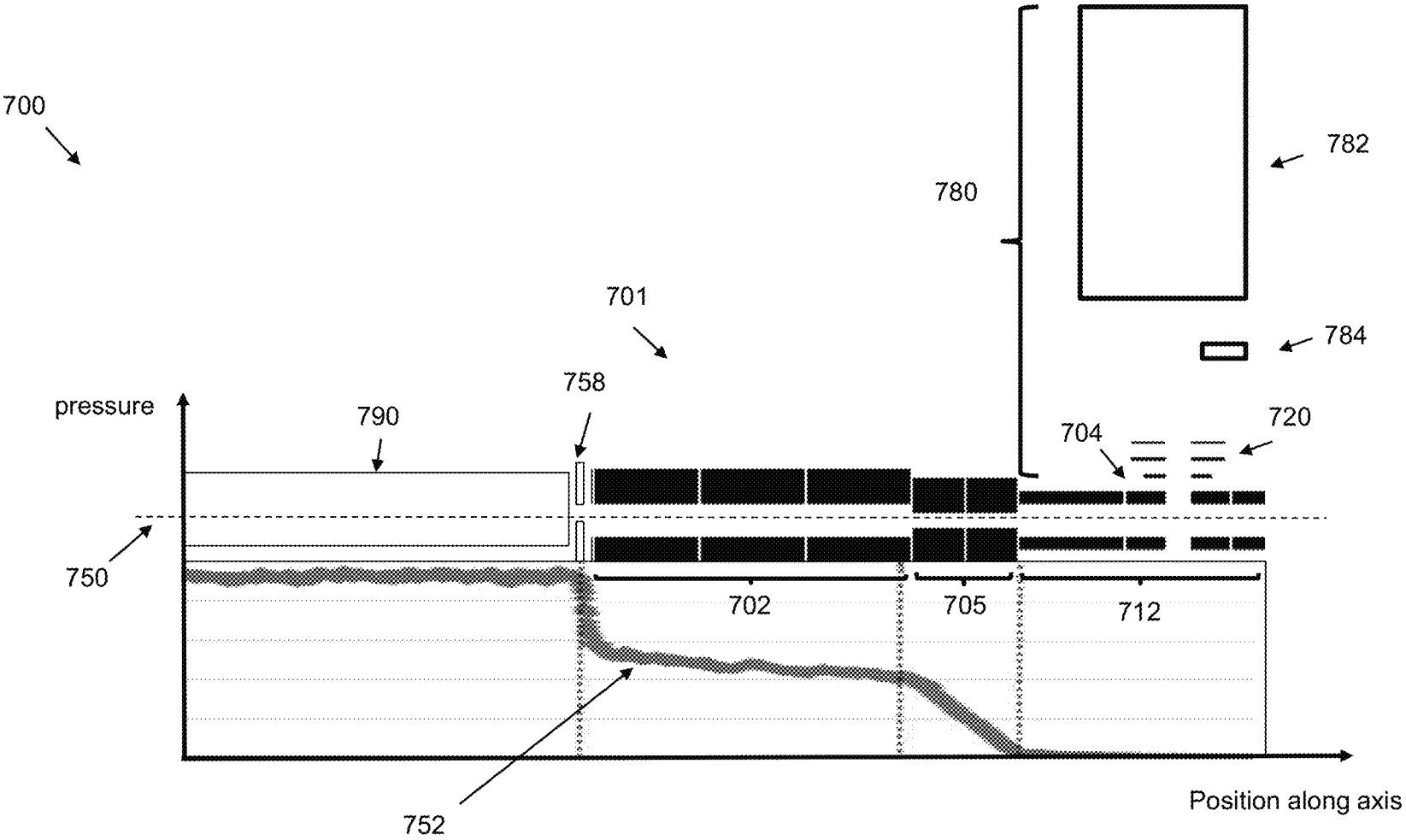
FIG. 7 shows an example mass analysis apparatus according to the invention, and a corresponding axial pressure profile.

FIG. 7 shows an example mass analysis apparatus 700 (which is a "LIT-TOF") according to the invention.

Features of FIG. 7 corresponding to those shown in FIG. 6 have been given alike reference numerals where possible.

Experimental data was obtained using the mass analysis apparatus 700 of FIG. 7.

The ion source 790 is a collision cell which supplied ions to the segmented linear ion trap 701. All parts are contained in a single vacuum chamber, not shown.

The plot 752 in FIG. 7 indicates the pressure distribution along the axis 750 (as calculated using a Monte Carlo simulation method for tracking and calculating statistic data of the buffer gas molecules: such simulations are well known). A pressure may be set in the collision cell 790 by means of a gas supply. Buffer gas may pass from collision cell 790 through aperture 758 into the first chamber having the first subset 702 of segments.

Due to the low fluid conductance of the gas flow restricting section 705 there may be a substantial reduction in the pressure between the first chamber having the first subset 702 of segments and the second chamber having the second subset 712 of segments. The collision cell 790, the aperture 758, the first subset 702 of segments and the conductance limiting portion 705, are mounted within a gas tight tube which defines the first chamber (not shown, but which corresponds to the tube 506 shown in FIG. 5). The second subset 712 of segments is open to the vacuum chamber which defines the second chamber, i.e. such that the gas conductance between the second subset 712 of segments and the chamber is high, meaning the pressure within the second subset 712 of segments is substantially independent of the pressure within the first subset 702 of segments. The vacuum chamber has a turbo molecular pump and a controllable gas supply for establishing a pressure within the first chamber and the second chamber. The controllable gas supply may help to make it easier to obtain a desired pressure in the second chamber, though could be omitted in some embodiments (e.g. since a desired pressure could be achieved by appropriately configuring the turbo molecular pump).

Argon gas was used for both the gas supply to the collision cell and the gas supply for the vacuum chamber. Also shown in FIG. 7 is an ion mirror 782 and an ion detector 784. Target segment 704, extraction lens electrodes 720, ion mirror 782 and ion detector 784 together form a TOF mass analyser 780 capable of recording the mass spectrum of ions trapped within 704.

In this example, the first chamber does not have its own gas supply, since the gas pressure in the first chamber can be controlled by aperture 758, though in other embodiments the first chamber could be provided with its own gas supply.

Properties of the target segment 704, the extraction lens electrodes 720, the ion mirror 782 and the ion detector 784 may all affect the mass resolving power which can be achieved. But here we concern ourselves with the ion temperature of the ions in 704 at the moment of extraction.

Experimental Work 1

Figure 8:
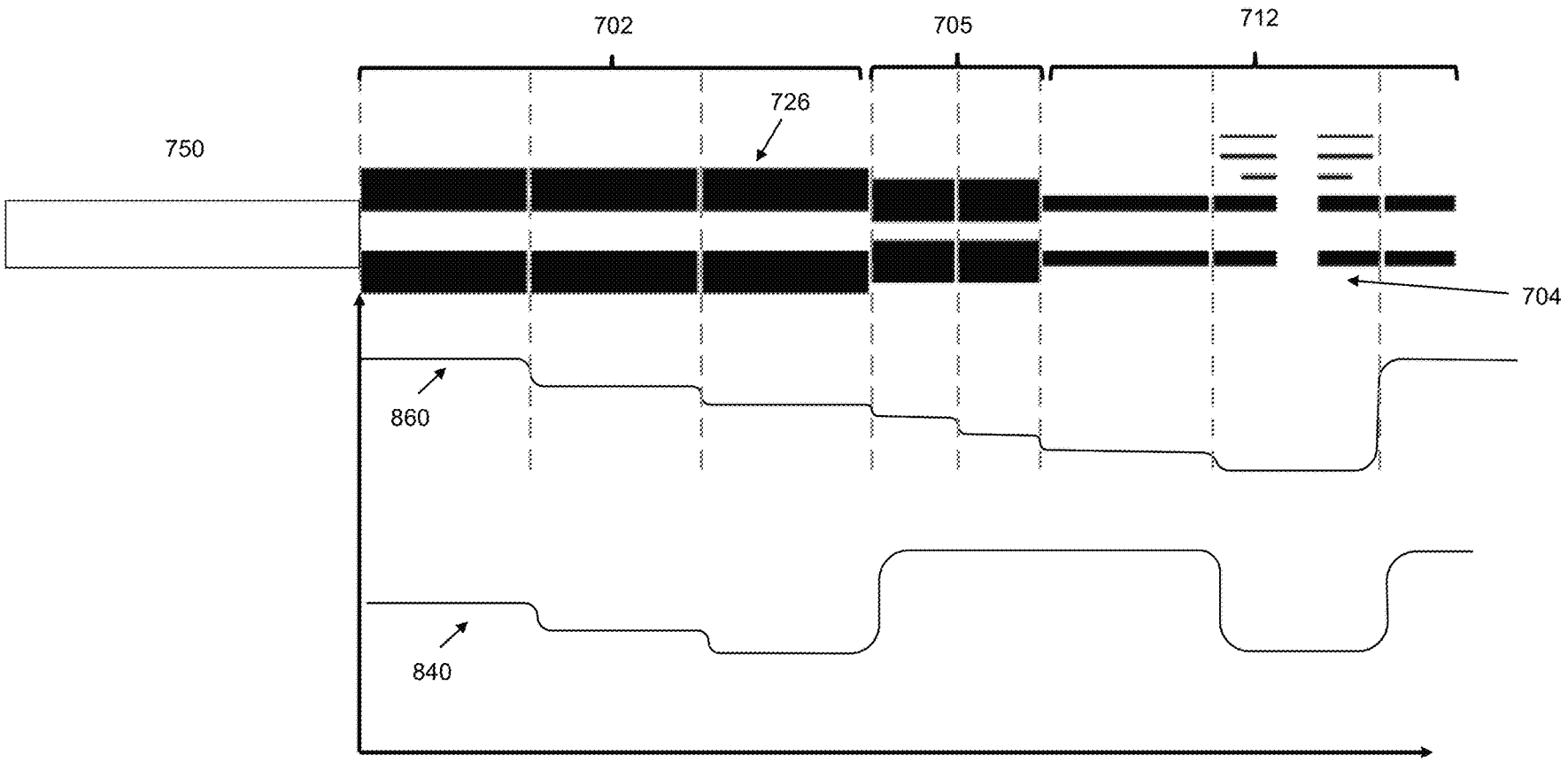
FIG. 8 shows the mass analysis apparatus of FIG. 7 alongside an illustration of DC voltages respectively applied to the segments of the mass analysis apparatus in different operating modes used to obtain results from experimental work 1 and 2.

FIG. 8 shows the mass analysis apparatus 700 of FIG. 7 alongside an illustration of DC voltages respectively applied to the segments of the mass analysis apparatus 700 in different operating modes used to obtain results from experimental work 1 and 2.

The DC voltages of the pre-trapping mode, i.e. the DC voltages respectively applied to the segments in the pre-trapping mode, are indicated by reference numeral 840 in FIG. 8.

The DC voltages of the trapping mode, i.e. the DC voltages respectively applied to the segments in the trapping mode, are indicated by reference numeral 860 in FIG. 8.

In experimental work 1, no gas was admitted to the collision cell 750, but gas was admitted to the second chamber containing target segment 704. This mode of operation replicates the prior art of D1 with target ion trap having effectively 6 segments.

The target segment 704 was set to a pressure of $7\times10^{-4}$ mbar (argon).

In experimental work 1, initially the DC voltages indicated by reference numeral 860 were applied to the segments. It may be seen that these DC voltages are used to move ions emergent from the collision cell 750 directly to, and then confine those ions in, the target segment 704.

In this experiment ions were trapped for a fixed duration of 10 ms using DC voltages indicated by reference numeral 860, the DC voltages indicated by reference numeral 840 were applied to the segments so as to stop any further ions from entering the gas flow restricting segment 705 and the target segment 704, which allowed for cooling of ions within the target segment 704.

The time allowed for ion cooling was varied from 0.5 to 20 ms. The received intensity expressed as a percentage of available ion current and the received peak resolving power are shown in FIG. 9(*b*) and FIG. 9(*c*) respectively.

Figure 9A:
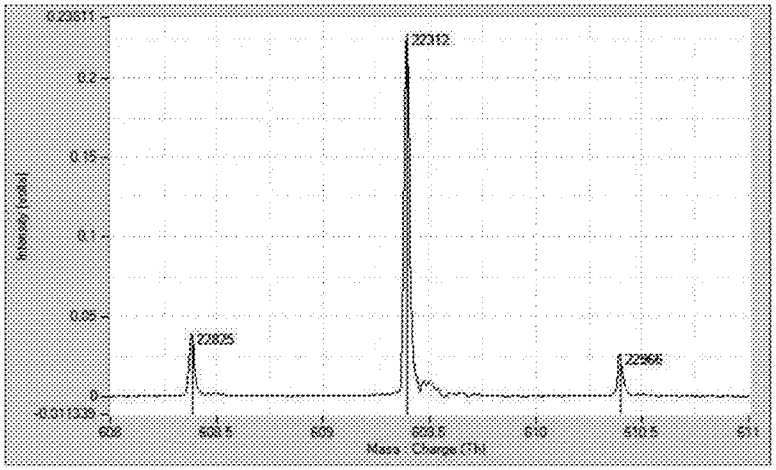
FIGS. 9(*a*)-(*c*) show results from experimental work 1.
Figure 9B:
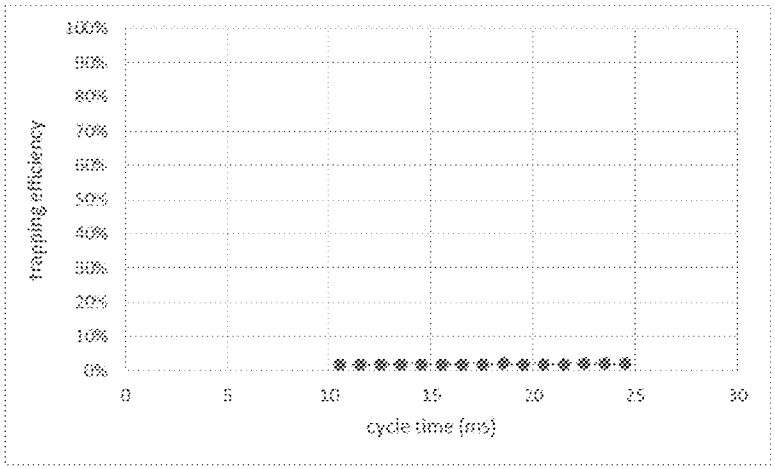
Figure 9C:
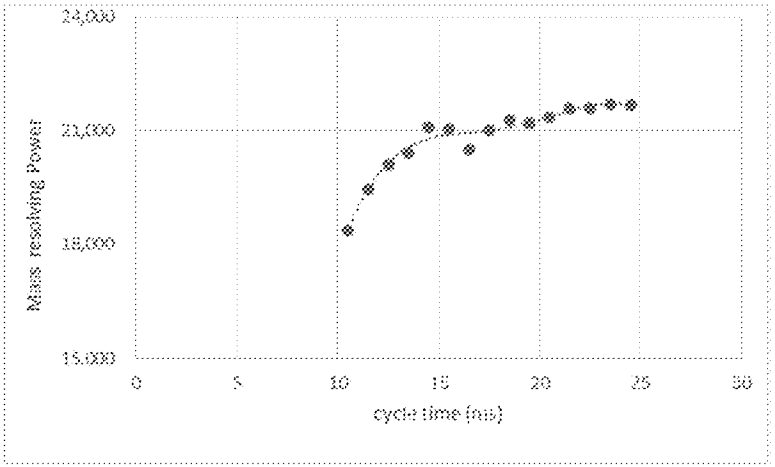

A TOF spectrum gained at longer cooling time is shown is shown in FIG. 9(*a*). The data shows a sharp drop in the TOF resolving power at cooling times below 15 ms. The trapping efficiency is low throughout. Thus the prior art operating mode is limited to low trapping efficiency and scan rate of ~66 Hz or lower.

Experimental Work 2

In experimental work 2, gas admitted to the collision cell 850 provided for a suitable pressure profile in the first chamber having the first subset 702 of segments. The conductance limiting segment 705 provided a high-pressure gradient and thus a large pressure difference between the first chamber having the first subset 702 of segments and the target segment 704 in the second chamber of at least 3 orders of magnitude. In this experiment, additional argon gas was supplied to the second chamber containing the target segment 704 to establish a pressure there of $2\times10^{-4}$ mbar. The pressure in the first chamber having the first subset 702 of segments was in the region of $1\times10^{-2}$ mbar.

In experimental work 2, ions emergent from the collision cell 750 were transferred directly to the target segment 704 using DC voltages indicated by reference numeral 860 in FIG. 8. During this time, which can be referred to as 'trapping' step, the DC voltages indicated by reference numeral 860 serve to trap ions within target segment 704. The duration that the DC voltages indicated by reference numeral 860 were applied may therefore be referred to as the 'trapping time'.

Following the 'trapping' time during which ions were accumulated in the target segment 704, the DC voltages indicated by reference numeral 840 were applied. These DC voltages were effective to prevent further ions entering the target segment 704 and at the same time allowed those ions already trapped within the target segment 704 to progress towards a thermal equilibrium with the gas. The time the DC voltages indicated by reference numeral 840 were applied may be referred to as the 'cooling' time. The final stage was extraction of ions in an orthogonal direction towards an ion mirror. In this stage the mass spectrum of the sample ions was obtained.

In experimental work 2, the 'trapping' time was 0.4 ms and the 'cooling' time was varied between 0.5 ms and 15 ms in small increments. The sum of the 'trapping time' and the 'cooling time' is hereafter referred to the 'cycle time'. The 'cycle time' represents the minimum time between the collection of successive spectra. The inverse of the 'cycle time' is hereafter referred to as the 'scan rate'.

Figure 10A:
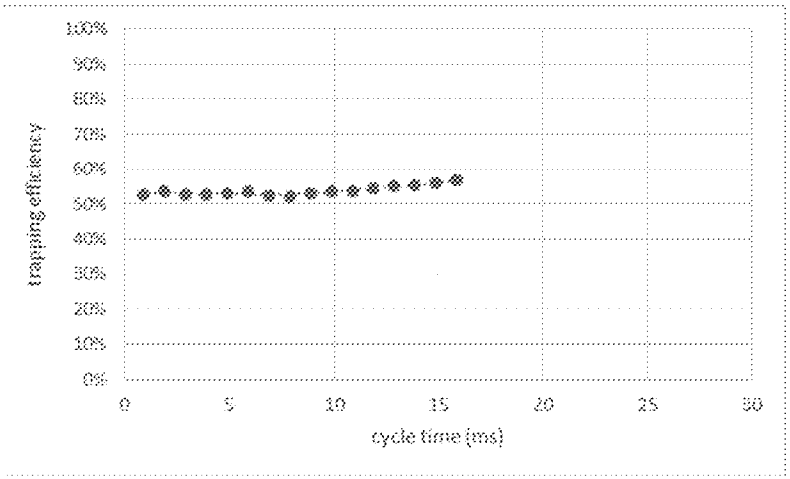
FIGS. 10(*a*)-(*b*) show results from experimental work 2.
Figure 10B:
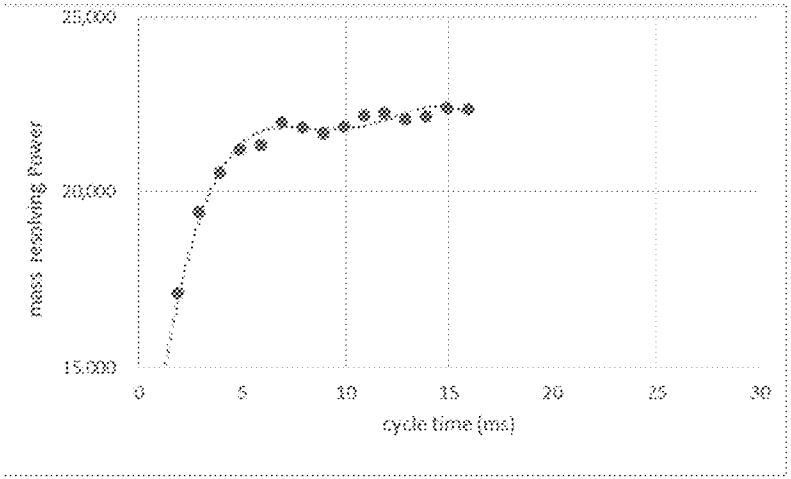

The 'cooling' time was varied to obtain the data presented in FIG. 10.

FIG. 10(*a*) shows the received trapping efficiency plotted against the cycle time and FIG. 10(*b*) shows the mass resolving power received against the cycle time.

The results of experimental work 2 shown in FIG. 10 demonstrate the performance enhancement of the current invention compared to the prior art performance indicated by experimental work 1 as shown in FIG. 9. The received resolving power in these experiments is a measure of the ion cloud temperature in the target segment 704 at the moment ions are extracted from the target segment 704 into the TOF analyser. The dependence of the trapping efficiency is a measure of the ion temperature as ions enter the target segment 704. The dependence of the trapping efficiency with respect to cooling is a measure of the axial or radial size of ion cloud at the time ions are extracted from target segment 704 into the TOF analyser.

In this mode of operations ions are transferred through the high-pressure region of the ion guide.

The pressure in the second chamber having the target segment 704 was 3.5 lower times than the corresponding pressure in experimental work 1. Operating a lower pressure offers the advantages as described previously. At the same time the trapping efficiency was improved from 2% to 50%, and the minimum cycle time is reduced from 15 ms (66 Hz) to 5 ms (200 Hz).

This represents a substantial improvement compared to the prior art device.

Experimental Work 3

Experimental work 3 is described with reference to FIG. 11.

Figure 11:
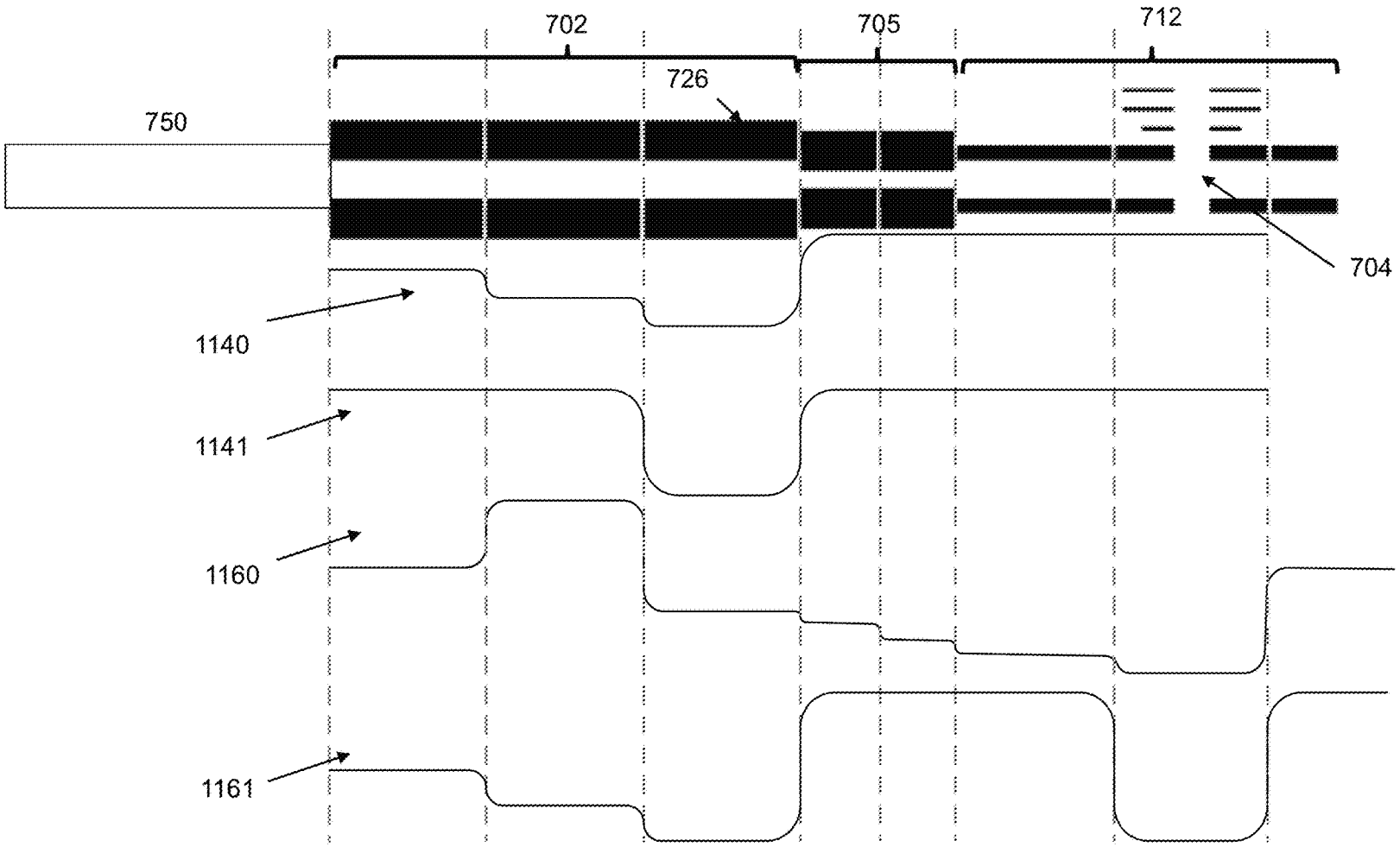
FIG. 11 shows the mass analysis apparatus of FIG. 7 alongside an illustration of DC voltages respectively applied to the segments of the mass analysis apparatus in different operating modes used to obtain results from experimental work 3.

FIG. 11 shows the mass analysis apparatus 700 of FIG. 7 alongside an illustration of DC voltages respectively applied to the segments of the mass analysis apparatus 700 in a different operating mode used to obtain results from experimental work 3.

In this experimental work, all conditions were identical to that of experimental work 2, except that ions emergent from the collision cell 750 were first transferred to a pre-trapping segment 726 of the first subset 702 of segments, using DC voltages indicated by reference numeral 1140 in FIG. 11, the 'pre-trapping' step. The duration that DC voltages indicated by reference numeral 1140 in FIG. 11 were applied can therefore be referred to as 'pre-trapping' time.

Subsequently, the DC voltages indicated by reference numeral 1141 in FIG. 11 were applied. The duration that DC profile 1021 was applied may be referred to as 'pre-cooling' time.

Next, ions were transferred from the first subset 702 of segments to the target segment 704 by applying DC voltages indicated by reference numeral 1160 in FIG. 11. The duration that DC voltages indicated by reference numeral 1160 were applied may be referred to as 'trapping' time.

Next, the DC voltages indicated by reference numeral 1161 were applied, so as to provide some time for ions to cool in the target segment 704 (since the ions will have gained some kinetic energy whilst being transferred into the target segment 704). The duration that the DC voltages indicated by reference numeral 1161 were applied may be referred to as 'cooling' time.

At the end of the 'cooling' time, ions were extracted in an orthogonal direction from the target segment 704 towards the TOF analyser by application of the extraction voltage.

In this experiment the 'pre-trapping' time was set to 0.5 ms, the 'pre-cooling' time was set to 2 ms, the 'trapping' time was set to 2 ms and the 'cooling' time was varied between 0.5 ms and 15 ms. The resultant data is shown in FIG. 12.

Figure 12A:
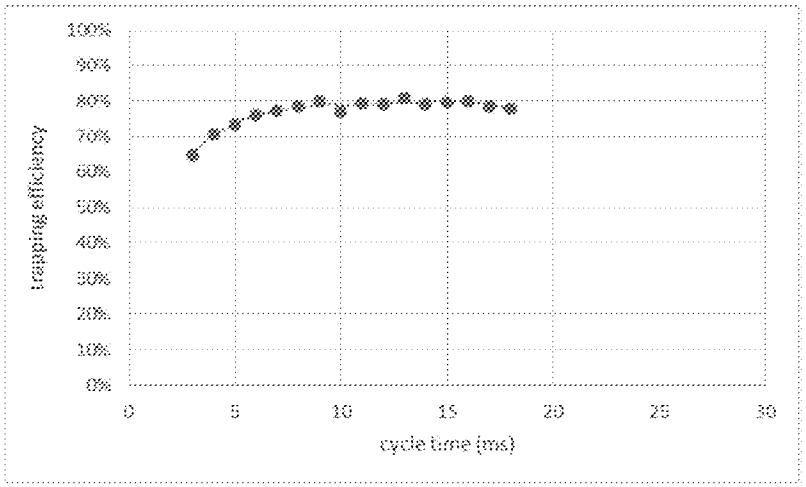
FIGS. 12(*a*)-(*b*) show results from experimental work 3.
Figure 12B:
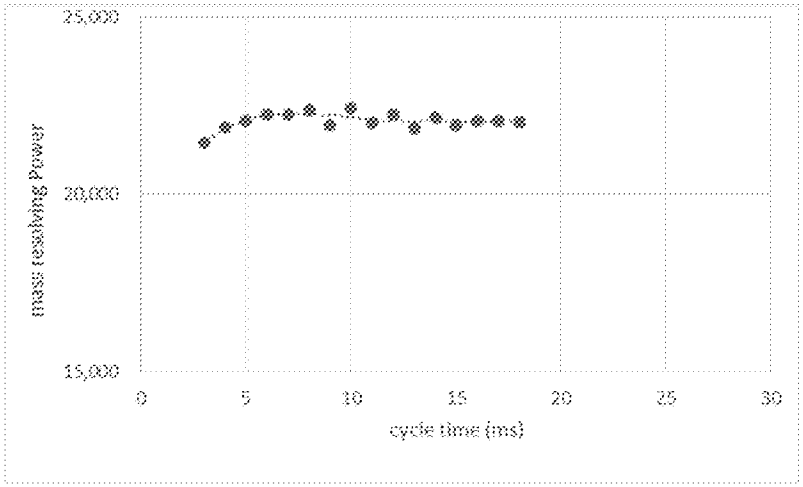

Note that for the purposes of FIG. 12, 'cycle time' as shown in FIG. 12 was defined as 'cooling time'+'trapping time'. As discussed below with reference to FIG. 13, this is the best theoretically achievable 'cycle time' provided the 'pre-trapping time'+pre-cooling time' remains shorter than the 'cooling time', as the pre-trapping and pre-cooling steps may be carried out simultaneous to the cooling step.

FIG. 12(*a*) shows trapping efficiency plotted against the cycle time and FIG. 12(*b*) shows the received mass resolving power plotted against the cycle time. These data demonstrate that it is possible to further reduce the cycle time without substantial performance compromise by operating in a pre-trapping mode. At the cycle time of 3 ms (scan rate of 333 Hz) the mass resolving power may be maintained at 22 k and the trapping efficiency shows only a small reduction from a maximum value of 80% to 65% at a scan rate of 333 Hz.

Figure 13:
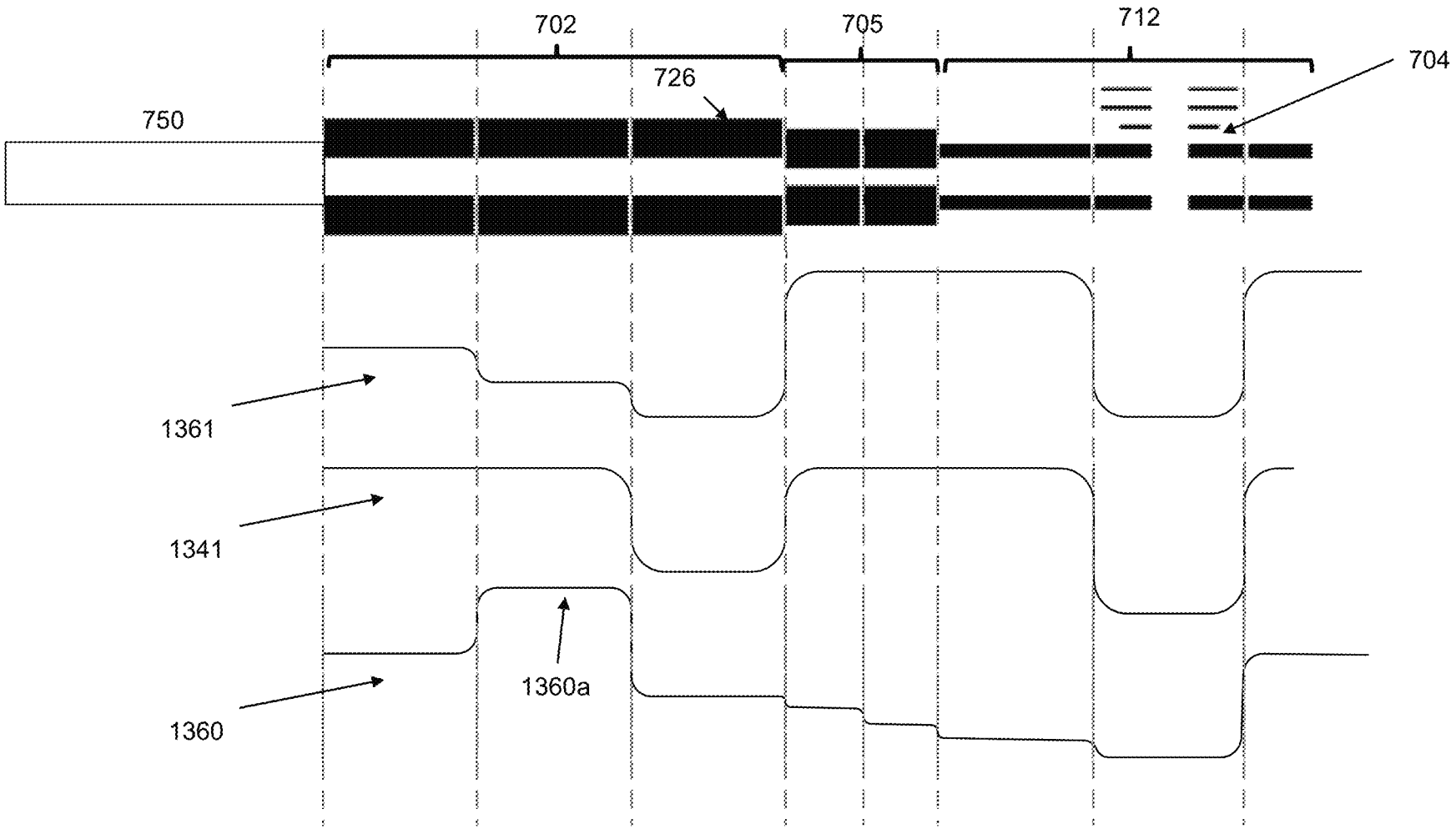
FIG. 13 illustrates a series of alternative DC voltage profiles that may be used to perform pre-trapping and pre-cooling simultaneous to the cooling step.

FIG. 13 illustrates a series of alternative DC voltage profiles that may be used to perform pre-trapping and pre-cooling simultaneous to the cooling step.

In FIG. 13, the DC voltages indicated by reference numeral 1361 are for simultaneously performing the 'pre-trapping' and 'cooling' steps noted above.

In FIG. 13, the DC voltages indicated by reference numeral 1341 are for simultaneously performing the 'pre-cooling' and 'cooling' steps noted above.

In FIG. 13, the DC voltages indicated by reference numeral 1360 are for performing the trapping step noted above. Note that the DC voltages indicated by reference numeral 1360 also provide a potential barrier 1360*a* upstream of the 'pre-trapping' segment so that only 'pre-trapped' ions are transferred into the target segment.

The 'pre-cooling' step (the DC voltages indicated by reference numeral 1341 may be omitted in some embodiments, i.e. with the DC voltages switching from the profile indicated by reference 1361 to the profile indicated by reference numeral 1360.

When used in this specification and claims, the terms "comprises" and "comprising", "including" and variations thereof mean that the specified features, steps or integers are included. The terms are not to be interpreted to exclude the possibility of other features, steps or integers being present.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

All references referred to above are hereby incorporated by reference.

The following statements, which form part of the description, provide general expressions of the disclosure herein:

A1. An ion trap having:

a segmented electrode structure having a plurality of segments consecutively positioned along an axis, wherein each segment of the segmented electrode structure includes a plurality of electrodes arranged around the axis;

a first voltage supply configured to operate in a radially confining mode in which at least some electrodes belonging to each segment are supplied with at least one AC voltage waveform so as to provide a confining electric field for radially confining ions within the segment;

a second voltage supply configured to operate in a trapping mode in which at least some of the electrodes belonging to the segments are supplied with different DC voltages so as to provide a trapping electric field that has an axially varying profile for urging ions towards and trapping ions in a target segment of the plurality of segments;

a first chamber configured to receive ions from an ion source, wherein a first subset of the segments are located within the first chamber;

a second chamber configured to receive ions from the first chamber, wherein a second subset of the segments are located within the second chamber, and wherein the target segment is one of the second subset of segments;

a gas pump configured to pump gas out from the second chamber so as to provide the second chamber with a lower gas pressure than the first chamber;

a gas flow restricting section located between the first chamber and second chamber, wherein the gas flow restricting section is configured to allow ions to pass from the first chamber to the second chamber whilst restricting gas flow from the first chamber to the second chamber.

A2. An ion trap according to statement A1, wherein the gas flow restricting section includes a wall between the first chamber and the second chamber, with at least one aperture being formed in the wall to allow ions to pass from the first chamber to the second chamber whilst restricting gas to flow from the first chamber to the second chamber, wherein the at least one aperture in the wall of the gas flow restricting section houses one or more segments of the plurality of segments.

A3. An ion trap according to statement A1 or A2, wherein the distance between the target segment in the second chamber and a last segment in the first chamber is 12 $r_{0t}$ or less, where $r_{0t}$ is the inscribed radius of the target segment, and the distance is measured along the axis from a centre of the target segment and a centre of the last segment in the first chamber.

A4. An ion trap according to any previous statement, wherein the ion trap is configured to provide a predetermined first pressure at a predetermined location in the first chamber and a predetermined second pressure at a predetermined location in the second chamber, when the ion trap is in use, wherein the first pressure is 10 or more times larger than the second pressure.

A5. An ion trap according to any previous statement, wherein the ion trap is configured to provide a predetermined first pressure at a predetermined location in the first chamber and a predetermined second pressure at a predetermined location in the second chamber, when the ion trap is in use, wherein the first pressure is $5\times10^{-3}$ mbar to $5\times10^{-2}$ mbar and the second pressure is $1\times10^{-5}$ mbar to $5\times10^{-4}$ mbar.

A6. An ion trap according to any previous statement, wherein the plurality of electrodes in each segment include a number of elongate electrodes which extend in the direction of the axis and are arranged to form a multipole ion guide.

A7. An ion trap according to any previous statement, wherein the second voltage supply is configured to operate in the trapping mode so that there are at least some pairs of adjacent segments for which there is a DC offset of 2 V or less between a DC voltage applied to at least one electrode in a first segment of the pair and a DC voltage applied to at least one electrode in a second segment of the pair.

A8. An ion trap according to any previous statement, wherein the second voltage supply is configured to operate in a thermalisation mode in which at least some of the electrodes belonging to the segments are supplied with different DC voltages so as to provide a thermalisation electric field that has an axially varying profile for trapping ions in the target segment located within the second chamber whilst preventing further ions from entering the target segment.

A9. An ion trap according to any previous statement, wherein the second voltage supply is configured to operate in a pre-trapping mode in which at least some of the electrodes belonging to the segments are supplied with different DC voltages so as to provide a pre-trapping electric field that has an axially varying profile for urging ions towards and trapping ions in a pre-trapping segment located within the first chamber.

A10. An ion trap according to statement A9, wherein the second voltage supply is configured to operate in a pre-thermalisation mode in which at least some of the electrodes belonging to the segments are supplied with different DC voltages so as to provide a pre-thermalisation electric field that has an axially varying profile for trapping ions in the pre-trapping segment located within the first chamber whilst preventing further ions from entering the pre-trapping segment to allow thermalisation of the ions trapped in the pre-trapping segment through collisions with gas particles.

A11. An ion trap according to statement A9 or A10, and is also according to statement A9, wherein the second voltage supply is configured to operate in the pre-trapping mode and/or the pre-thermalisation mode at the same time as the thermalisation mode.

A12. An ion trap according to any previous statement, wherein the ion trap includes a third voltage supply configured to operate in an extraction mode in which one or more extraction voltages are supplied to one or more electrodes of the target segment and/or one or more extraction electrodes.

A13. An ion trap according to statement A12, wherein the first voltage supply is configured to operate in an extraction mode in which an AC voltage waveform supplied to electrodes of the target segment in the radially confining mode are paused or stopped so as to allow ions to be extracted from the target segment, wherein the ion trap is configured to repeatedly perform an extraction cycle that includes:

the second voltage supply operating in the trapping mode for a first predetermined period of time to move ions towards and trap ions in the target segment;

the first and third voltage supplies operating in their extraction modes to extract ions from the target segment out of the ion trap.

A14. A mass analysis apparatus having:

an ion source;

an ion trap according to any previous statement, wherein the first chamber of the ion trap is configured to receive ions from the ion source;

a mass analyser for analysing ions extracted from the target segment of the ion trap.

A15. A mass analysis apparatus according to statement A14, wherein the ion source is configured to provide a continuous stream of ions to be received by the first chamber of the ion trap.

ANNEX

Explanation of Fluid Conductance

Pressure regimes where the mean free path of background gas molecules is of the order of (or longer than) the dimensions of the system, termed the molecular flow regime, are often employed in charged particle devices. At such pressures, the gas flow properties may be determined using simple theory. The pressure differential between two adjacent pressure areas may be defined as a relationship of the fluid conductance C between the two regions: the fluid conductance is a measure of the pumping speed between the two regions, in volumes per unit time, generally given in $m^3s^{-1}$ or $Ls^{-1}$. A larger fluid conductance results in a larger flow between the two volumes. In order to maintain a larger pressure differential between two volumes (assuming there is some net flow of gas into one of the two regions, e.g. from a pipe to a gas source), the fluid conductance should be made smaller. To reduce the pressure differential between two volumes the fluid conductance should be made larger, all other things being equal. Hence to maintain a larger pressure differential, a region of reduced fluid conductance is required.

Fluid conductance may be referred to as gas conductance, when the fluid concerned is gas.

It is well known from theory (see "A Users Guide to Vacuum Technology, Third Edition, J. F. O'Hanlon, Wiley, New York" pages 32-34) that, to a first approximation in the molecular flow regime, the conductance of an orifice in a plate $C_{hole}$ is given by:

$$C_{hole} = \frac{v}{4}A = \frac{v}{4}\pi r_{hole}^2$$

Where v is the average velocity of the gas, A is the areas of the hole and $r_{hole}$ is the radius of the hole. Hence for an aperture in a plate the conductance may be changed by changing the area or radius of the hole. For a long round tube, this fluid conductance $C_{tube}$ becomes:

$$C_{tube} = \frac{\pi}{12}v\frac{d_{tube}^3}{l} = \frac{\pi}{12}v\frac{(2r_{tube})^3}{l}$$

Where v is the average velocity of the gas, $d_{tube}$ is the diameter of the tube, $r_{tube}$ is the radius of the tube and l is the length of the tube.

To a first approximation, the gas flow restricting section 305 shown in FIG. 3 may be approximated to be a tube (better approximations are possible, but this approximation serves the purpose of demonstrating the principle of operation: the reader may extend the theory to a more accurate description of the gas flow properties of the structure if desired, e.g. through computer simulation). If it is desired to make the conductance of the gas flow restricting section 305 equal to the conductance of a round orifice in a plate, $C_{hole}$ and $C_{tube}$ may be set equal to one another, giving a range of tube geometries (of diameter and length) which would meet the criteria.

It can also be easily seen that increasing the length of the gas flow restricting section 305 shown in FIG. 3 allows a larger diameter 'tube' whilst retaining the same conductance i.e. the electrode-to-electrode separation may be increased, and hence a desired pressure differential may be maintained between the first chamber 303 and second chamber 324. Note that, as the fluid conductance scales with the cube of the diameter and only inversely to the length, especially large diameters become quickly impractical, as a very long tube length would be required to compensate for the large tube diameter whilst retaining the same gas conductance.

The invention claimed is:

1. An ion trap having:

a segmented electrode structure having a plurality of segments consecutively positioned along an axis, wherein each segment of the segmented electrode structure includes a plurality of electrodes arranged around the axis;

a first voltage supply configured to operate in a radially confining mode in which at least some electrodes belonging to each segment are supplied with at least one AC voltage waveform so as to provide a confining electric field for radially confining ions within the segment;

a second voltage supply configured to operate in a trapping mode in which at least some of the electrodes belonging to the segments are supplied with different DC voltages so as to provide a trapping electric field that has an axially varying profile for urging ions towards and trapping ions in a target segment of the plurality of segments;

a first chamber configured to receive ions from an ion source, wherein a first subset of the segments are located within the first chamber;

a second chamber configured to receive ions from the first chamber, wherein a second subset of the segments are located within the second chamber, and wherein the target segment is one of the second subset of segments;

a gas pump configured to pump gas out from the second chamber so as to provide the second chamber with a lower gas pressure than the first chamber;

a gas flow restricting section located between the first chamber and second chamber, wherein the gas flow restricting section is configured to allow ions to pass from the first chamber to the second chamber whilst restricting gas flow from the first chamber to the second chamber, wherein the gas flow restricting section includes a wall between the first chamber and the second chamber, with at least one aperture being formed in the wall to allow ions to pass from the first chamber to the second chamber whilst restricting gas to flow from the first chamber to the second chamber, wherein the at least one aperture in the wall of the gas flow restricting section houses one or more gas flow restricting segments of the plurality of segments, and wherein the one or more gas flow restricting segment has an inscribed radius that is smaller than the inscribed radius of a segment that is located entirely in the first chamber.

2. An ion trap according to claim 1, wherein the distance between the target segment in the second chamber and a last segment in the first chamber is 12 $r_{0t}$ or less, where $r_{0t}$ is the inscribed radius of the target segment, and the distance is measured along the axis from a centre of the target segment and a centre of the last segment in the first chamber.

3. An ion trap according to claim 1, wherein the ion trap is configured to provide a predetermined first pressure at a predetermined location in the first chamber and a predetermined second pressure at a predetermined location in the second chamber, when the ion trap is in use, wherein the first pressure is 10 or more times larger than the second pressure.

4. An ion trap according to claim 1, wherein the ion trap is configured to provide a predetermined first pressure at a predetermined location in the first chamber and a predetermined second pressure at a predetermined location in the second chamber, when the ion trap is in use, wherein the first pressure is $5\times10^{-3}$ mbar to $5\times10^{-2}$ mbar and the second pressure is $1\times10^{-5}$ mbar to $5\times10^{-4}$ mbar.

5. An ion trap according to claim 1, wherein the plurality of electrodes in each segment include a number of elongate electrodes which extend in the direction of the axis and are arranged to form a multipole ion guide.

6. An ion trap according to claim 1, wherein the second voltage supply is configured to operate in the trapping mode so that there are at least some pairs of adjacent segments for which there is a DC offset of 2 V or less between a DC voltage applied to at least one electrode in a first segment of the pair and a DC voltage applied to at least one electrode in a second segment of the pair.

7. An ion trap according to claim 1, wherein the second voltage supply is configured to operate in a thermalisation mode in which at least some of the electrodes belonging to the segments are supplied with different DC voltages so as to provide a thermalisation electric field that has an axially varying profile for trapping ions in the target segment located within the second chamber whilst preventing further ions from entering the target segment.

8. An ion trap according to claim 1, wherein the second voltage supply is configured to operate in a pre-trapping mode in which at least some of the electrodes belonging to the segments are supplied with different DC voltages so as to provide a pre-trapping electric field that has an axially varying profile for urging ions towards and trapping ions in a pre-trapping segment located within the first chamber, wherein the pre-trapping segment is closer to the second chamber than any other segment of the first subset of the segments located entirely within the first chamber.

9. An ion trap according to claim 8, wherein the second voltage supply is configured to operate in a pre-thermalisation mode in which at least some of the electrodes belonging to the segments are supplied with different DC voltages so as to provide a pre-thermalisation electric field that has an axially varying profile for trapping ions in the pre-trapping segment located within the first chamber whilst preventing further ions from entering the pre-trapping segment to allow thermalisation of the ions trapped in the pre-trapping segment through collisions with gas particles.

10. An ion trap according to claim 9, wherein the second voltage supply is configured to operate in the pre-trapping mode and/or the pre-thermalisation mode at the same time as a thermalisation mode in which at least some of the electrodes belonging to the segments are supplied with different DC voltages so as to provide a thermalisation electric field that has an axially varying profile for trapping ions in the target segment located within the second chamber whilst preventing further ions from entering the target segment.

11. An ion trap according to claim 1, wherein the ion trap includes a third voltage supply configured to operate in an extraction mode in which one or more extraction voltages are supplied to one or more electrodes of the target segment and/or one or more extraction electrodes.

12. An ion trap according to claim 11, wherein the first voltage supply is configured to operate in an extraction mode in which an AC voltage waveform supplied to electrodes of the target segment in the radially confining mode are paused or stopped so as to allow ions to be extracted from the target segment, wherein the ion trap is configured to repeatedly perform an extraction cycle that includes:

the second voltage supply operating in the trapping mode for a first predetermined period of time to move ions towards and trap ions in the target segment;

the first and third voltage supplies operating in their extraction modes to extract ions from the target segment out of the ion trap.

13. The ion trap according to claim 8, wherein a DC voltage supplied to the pre-trapping segment is lower than a DC voltage applied to any other segment of the first subset of the segments located within the first chamber.

14. The ion trap according to claim 13, wherein the one or more gas flow restricting segments include a plurality of axially extending electrodes.

15. A mass analysis apparatus having:

an ion source;

an ion trap;

wherein the ion trap has:

a segmented electrode structure having a plurality of segments consecutively positioned along an axis, wherein each segment of the segmented electrode structure includes a plurality of electrodes arranged around the axis;

a first voltage supply configured to operate in a radially confining mode in which at least some electrodes belonging to each segment are supplied with at least one AC voltage waveform so as to provide a confining electric field for radially confining ions within the segment;

a second voltage supply configured to operate in a trapping mode in which at least some of the electrodes belonging to the segments are supplied with different DC voltages so as to provide a trapping electric field that has an axially varying profile for urging ions towards and trapping ions in a target segment of the plurality of segments;

a first chamber configured to receive ions from an ion source, wherein a first subset of the segments are located within the first chamber;

a second chamber configured to receive ions from the first chamber, wherein a second subset of the segments are located within the second chamber, and wherein the target segment is one of the second subset of segments;

a gas pump configured to pump gas out from the second chamber so as to provide the second chamber with a lower gas pressure than the first chamber;

a gas flow restricting section located between the first chamber and second chamber, wherein the gas flow restricting section is configured to allow ions to pass from the first chamber to the second chamber whilst restricting gas flow from the first chamber to the second chamber wherein the first chamber of the ion trap is configured to receive ions from the ion source;

a mass analyser for analysing ions extracted from the target segment of the ion trap;

wherein the gas flow restricting section includes a wall between the first chamber and the second chamber, with at least one aperture being formed in the wall to allow ions to pass from the first chamber to the second chamber whilst restricting gas to flow from the first chamber to the second chamber, wherein the at least one aperture in the wall of the gas flow restricting section houses one or more gas flow restricting segments of the plurality of segments, and wherein the one or more gas flow restricting segment has an inscribed radius that is smaller than the inscribed radius of a segment that is located entirely in the first chamber.

16. A mass analysis apparatus according to claim 15, wherein the ion source is configured to provide a continuous stream of ions to be received by the first chamber of the ion trap.

17. The mass analysis apparatus according to claim 15, wherein the second voltage supply is configured to operate in a pre-trapping mode in which at least some of the electrodes belonging to the segments are supplied with different DC voltages so as to provide a pre trapping electric field that has an axially varying profile for urging ions towards and trapping ions in a pre-trapping segment located within the first chamber, wherein the pre-trapping segment is closer to the second chamber than any other segment of the first subset of the segments located entirely within the first chamber, and wherein a DC voltage supplied to the pre-trapping segment is lower than a DC voltage applied to any other segment of the first subset of the segments located within the first chamber.

18. The mass analysis apparatus according to claim 17, wherein the one or more gas flow restricting segments include a plurality of axially extending electrodes.

* * * * *